US005695915A

United States Patent [19]

Ueda et al.

[11] Patent Number: 5,695,915

[45] Date of Patent: *Dec. 9, 1997

[54] PROCESSING METHOD FOR SILVER HALIDE COLOR PHOTOGRAPHIC LIGHT-SENSITIVE MATERIAL

[75] Inventors: Yutaka Ueda; Kenji Kuwae, both of Hino, Japan

[73] Assignee: Konica Corporation, Tokyo, Japan

[ * ] Notice: The term of this patent shall not extend beyond the expiration date of Pat. No. 5,580,705.

[21] Appl. No.: 168,984

[22] Filed: Dec. 17, 1993

Related U.S. Application Data

[62] Division of Ser. No. 912,312, Jul. 13, 1992, abandoned.

[30] Foreign Application Priority Data

Sep. 11, 1991 [JP] Japan ..... 3-231900

[51] Int. Cl.[6] ..... G03C 7/00; G03C 5/18; G03C 5/26; G03C 5/44

[52] U.S. Cl. ..... 430/393; 430/418; 430/430; 430/460; 430/461

[58] Field of Search ..... 430/393, 418, 430/430, 460, 461; 556/17, 148; 252/186.33

[56] References Cited

U.S. PATENT DOCUMENTS

| | | | |
|---|---|---|---|
| 2,810,753 | 10/1957 | Bersworth | 556/148 |
| 3,077,487 | 2/1963 | Ramsey et al. | 556/148 |
| 4,546,070 | 10/1985 | Kishimoto et al. | 430/461 |
| 4,704,233 | 11/1987 | Hartman et al. . | |
| 4,717,647 | 1/1988 | Abe et al. | 430/461 |
| 4,804,618 | 2/1989 | Ueda et al. | 430/461 |
| 5,063,190 | 11/1991 | Kuse et al. | 430/461 |
| 5,580,705 | 12/1996 | Ueda et al. | 430/430 |
| 5,585,226 | 12/1996 | Strickland et al. | 430/430 |

FOREIGN PATENT DOCUMENTS

| | | |
|---|---|---|
| 0 395 442 | 10/1990 | European Pat. Off. . |
| 0 430 000 | 6/1991 | European Pat. Off. . |
| 0532003 | 3/1993 | European Pat. Off. . |
| 3 939 756 | 6/1991 | Germany . |
| 1 336 102 | 11/1973 | United Kingdom . |

OTHER PUBLICATIONS

Database WPIL, Section Ch, Week 8423, Derwent Publications Ltd., London, GB; london, GB; Class CO4, AN 84-145630 & SU-A-1 043 137 (AS UKR GEN INORG CHEM) 23 Sep. 1983 * abstract *.

Chemical Abstracts, vol. 65, 1966, Columbus, Ohio, US; abstract No. 11738f, * abstract * & Chemi. Zvesti, vol. 20, No. 6, 1966, pp. 414–422 J. Majer et al.

J.A. Neal, N.J. Rose, *Inorg. Chem.* 1968, 7, 2405.

K. Uneo, *Chelate Chemistry,* vol. 5, section 2, pp. 309, 311, 329.

*Shashin Yougo Jiten* (Dictionary of Photographic Terms), Committe of Photographic Terms of the Society of Phtographic Science & Technology of Japan, 1976, p. 86.

*Primary Examiner*—Glenn A. Caldarola
*Assistant Examiner*—J. Pasterczyk
*Attorney, Agent, or Firm*—Frishauf, Holtz, Goodman, Langer & Chick, P.C.

[57] ABSTRACT

A method used for processing a silver halide photographic light sensitive material including steps of developing and treating with a solution having bleaching capability. The solution having bleaching capability comprises a ferric complex salt of a compound represented by the following formula A:

(A)

wherein $A_1$, $A_2$, $A_3$ and $A_4$ are independently a $—CH_2OH$ group, a $—PO_3M_2$ group or a —COOM group, which may be the same or different; M is a cation: and X is an alkylene group having 2 to 6 carbon atoms or a $—(B_1O)_n—B_2—$ group, in which is an integer of 1 to 8, $B_1$ and $B_2$ are independently an alkylene group having 1 to 5 carbon atoms, which may be the same or different. The solution can be used as a bleaching solution or bleach-fixing solution for color photographic material. The solution may further be used as a reducing solution for reducing an image formed on a photographic light-sensitive material.

21 Claims, No Drawings

PROCESSING METHOD FOR SILVER HALIDE COLOR PHOTOGRAPHIC LIGHT-SENSITIVE MATERIAL

This application is a Division of application Ser. No. 07/912,312, filed Jul. 13, 1992 (abandoned).

FIELD OF THE INVENTION

The present invention relates to a processing liquid for a silver halide color photographic light-sensitive material, more specifically to a bleaching solution or bleach-fixer improved in processing performance, desilvering property and biodegradability. The present invention is also concerned with a reducer for a light-sensitive material for photomechanical process, which is safe due to its excellent biodegradability.

BACKGROUND OF THE INVENTION

In the processing of a light-sensitive material, bleaching is normally conducted to remove silver of images therefrom. Nowadays, a bleaching solution or bleach-fixer that contains a metal complex salt of an aminopolycarboxylic acid, such as a ferric complex salt of ethylenediaminetetraacetic acid and a ferric complex salt of 1,3-propylenediaminetetraacetic acid, is widely employed in the photographic industry.

A ferric complex salt of 1,3-propylenediaminetetraacetic acid is useful for the rapid processing of a high-speed film since it has an extremely high oxidizing activity. However, such high oxidizing activity inevitably causes a color developing agent that has been brought into a bleaching solution or bleach-fixer bath from the preceding processor bath to be oxidized. The oxidized color developing agent is coupled with unreacted couplers to form a dye, causing an unfavorable "bleach fogging" phenomenon.

A ferric complex salt of ethylenediaminetetraacetic acid, which has smaller oxidizing activity than a ferric complex salt of 1,3-propylenediaminetetraacetic acid, is widely employed as a bleaching agent for a bleach-fixer. A bleach-fixer is a processing liquid which is employed in the bleach-fixing step where bleaching and fixing are conducted simultaneously using the same processing liquid for the simplification and speed-up of processing procedure. In a bleach-fixer, a bleaching agent serves as an oxidant and a fixing agent, normally thiosulfate ions, serves as a reducing agent. Thiosulfate ions are decomposed into sulfur when they are oxidized by a bleaching agent. To prevent this phenomenon, sulfite ions are generally added to a bleach-fixer as a preservative. Meanwhile, a ferric complex salt of ethylenediaminetetraacetic acid changes itself from a divalent state to a trivalent state extremely rapidly. Therefore, it maintains its trivalent state in a bleach-fixer, and keeps on decomposing sulfite ions. As a result, decomposition of thiosulfate ions is accelerated, causing the bleach-fixer to have poor storage stability.

To solve this problem, Japanese Patent Publication Open to Public Inspection (hereinafter abbreviated as Japanese Patent O.P.I. Publication) Nos. 149358/1984, 151154/1984 and 166977/1984 each disclose the use of a ferric complex salt of diethylenetriaminepentaacetic acid.

A bleach-fixer that contains a ferric complex salt of diethylenetriaminepentaacetic acid has better storage stability than that which contains a ferric complex salt of ethylenediaminetetraacetic acid. However, the use of a ferric complex salt of diethylenetriaminepentaacetic acid in the processing of color paper causes a so-called "edge penetration" phenomenon, in which the edge portion of color paper is stained.

A ferric complex salt of ethylenetriaminetetraacetic acid and a ferric complex salt of diethylenepentaacetic acid are known to have extremely poor biodegradability, which is unfavorable with respect to environmental protection. Some countries are, therefore, trying to impose restrictions on the use of these salts.

Under such circumstances, there is a strong demand for a bleaching solution which can perform desilvering rapidly without causing bleach fogging, and a bleach-fixer which is improved in desilvering ability, storage stability and biodegradability, and free from the "edge penetration" problem.

Meanwhile, conventional reducers for light-sensitive materials for photomechanical use are highly acidic, and, hence, should be handled carefully. A demand for a reducer which does not contain any toxic substances, and hence, is easy to handle has been on the increase.

SUMMARY OF THE INVENTION

One object of the present invention is to provide a processing liquid with a bleaching power for a silver halide color photographic light-sensitive material which is improved in desilvering property, storage stability and biodegradability and hardly causes the edge portion of color paper to be stained.

Another object of the present invention is to provide a reducer for a light-sensitive material for photomechanical use which is improved in biodegradability and safety.

The above object can be attained by a processing solution for a silver halide light-sensitive material which contains a ferric complex salt of a compound represented by formula A:

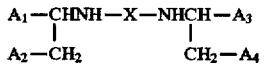

wherein $A_1$ to $A_4$, whether identical or not, each represent $—CH_2OH$, $—PO_3M_2$ or —COOM; M represents a hydrogen atom, or a cation; X represents a substituted or unsubstituted alkylene group with 2 to 6 carbon atoms or $—(B_1O)_n—B_2—$ (where $B_1$ and $B_2$, whether identical or not, each represent a substituted or unsubstituted alkylene group with 1 to 5 carbon atoms); and n represents an integer of 1 to 8.

DETAILED DESCRIPTION OF THE INVENTION

An explanation will be made of compounds represented by formula A.

In the formula, $A_1$ to $A_4$, whether identical or not, each represent $—CH_2OH$, $—PO_3M_2$ or —COOM. M represents a hydrogen ion, an alkali metal ion, e.g. a sodium ion, a potassium ion, or another cation, e.g. an ammonium ion, a methyl ammonium ion, a trimethyl ammonium ion. X represents a substituted or unsubstituted alkylene group with 2 to 6 carbon atoms or $—(B_1O)_n—B_2—$, where $B_1$ and $B_2$ each represent an alkylene group with 1 to 5 carbon atoms. The alkylene group represented by X include ethylene, trimethylene and tetramethylene. The alkylene group represented by $B_1$ or $B_2$ include methylene, ethylene and trimethylene. Examples of substituents for the alkylene group represented by X, $B_1$ or $B_2$ include a hydroxy group and an alkyl group with 1 to 3 carbon atoms, e.g. methyl, ethyl. n represents an integer of 1 to 8, preferably 1 to 4, still preferably 1 to 2, most preferably 1. Preferred examples of compounds represented by formula A are given below:

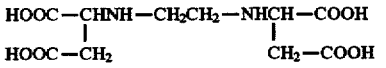
A-1

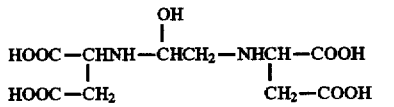
A-2

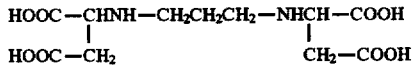
A-3

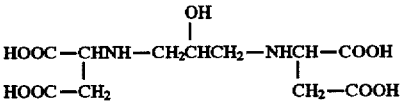
A-4

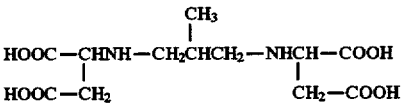
A-5

A-6

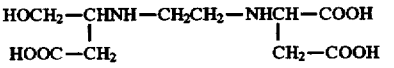
A-7

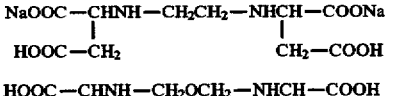
A-8

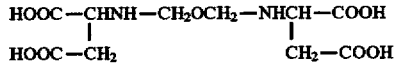
A-9

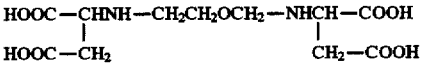
A-10

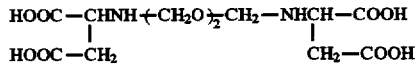
A-11

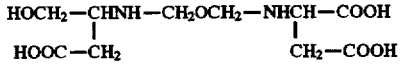
A-12

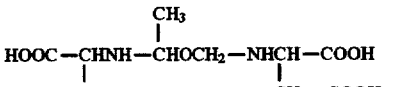
A-13

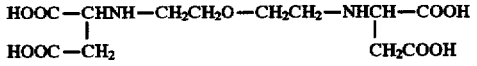
A-14

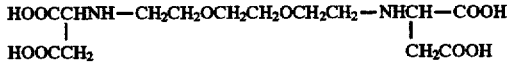
A-15

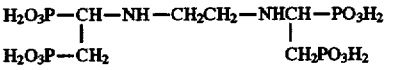
A-16

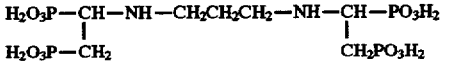
A-17

Compounds represented by formula A can be prepared by a known method.

Of compounds A-1 to A-17, compounds A-1, A-3 and A-14 are especially preferable in the invention.

Compounds represented by formula A can be contained in any of processing liquids which are employed for processing a silver halide photographic light-sensitive material, but the effects of these compounds are manifested successfully when employed in a bleaching solution, bleach-fixer or reducer. Most preferably, these compounds should be contained in a bleaching solution or bleach-fixer.

These compounds are added to a bleaching solution or bleach-fixer preferably in amounts of 0.05 to 2.0 mol, still preferably 0.1 to 1.0 mol, per liter of the bleaching solution or bleach-fixer.

In the present invention, besides compounds represented by formula A, a bleaching solution or bleach-fixer may also contain a ferric complex salt of any one of the following organic acids:

[A'-1] Ethylenediaminetetraacetic acid
[A'-2] Trans-1,2-cyclohexanediaminetetraacetic acid
[A'-3] Dihydroxyethylglycinic acid
[A'-4] Ethylenediaminetetraxismethylenephosphonic acid
[A'-5] Nitrilotrismethylenephosphonic acid
[A'-6] Diethylenetriaminepentakismethylenephosphonic acid
[A'-7] Diethylenetriaminepentaacetic acid
[A'-8] Ethylenediaminediorthohydroxyphenylacetic acid
[A'-9] Hydroxyethylethylenediaminetriacetic acid
[A'-10] Ethylenediaminepropionic acid
[A'-11] Ethylenediaminediacetic acid
[A'-12] Hydroxyethyliminodiacetic acid
[A'-13] Nitrilotriacetic acid
[A'-14] Nitrilotripropionic acid
[A'-15] Triethylenetetraminehexaacetic acid
[A'-16] Ethylenediaminetetrapropionic acid A ferric complex salt of the above organic acid is contained in a bleaching solution or bleach-fixer preferably in an amount of 0.05 to 2.0 mol, still preferably 0.10 to 1.5 mol, per liter of the bleaching solution or bleach-fixer.

For rapid processing, a bleacher or bleach-fixer may preferably contain, as a bleaching accelerator, at least one member selected from imidazole compounds described in Japanese Patent O.P.I. Publication No. 295258/1989, derivatives thereof and compounds represented by any one of formulae I to IX (including example compounds) described in this publication.

Example compounds described on pages 51 to 115 of Japanese Patent O.P.I. Publication No. 123459/1987, example compounds described on pages 22 to 25 of Japanese Patent O.P.I. Publication No. 17445/1988, as well as compounds described in Japanese Patent O.P.I. Publication Nos. 95630/1978 and 28426/28426 are also usable.

The temperature of a bleaching solution or bleach-fixer should preferably be 20° to 50° C., still preferably 25° to 45° C.

The pH of a bleaching solution should preferably be 6.0 or less, still preferably 1.0 to 5.5. The pH of a bleach-fixer should preferably be 5.0 to 9.0, still preferably 6.0 to 8.5. Here, the pH of a bleaching solution or bleach-fixer is distinguished from that of a bleaching solution, or bleach-fixer, replenisher.

A bleaching solution or bleach-fixer may also contain a halide such as ammonium bromide, potassium bromide and sodium bromide, a fluorescent brightener, a defoaming agent and a surfactant.

A bleaching solution replenisher or bleach-fixer replenisher should normally be employed in an amount of 500 ml or less, preferably 20 ml to 400 ml, still preferably 40 ml to 350 ml, per square meter of a light-sensitive material. The smaller the amount of a replenisher, the more successfully the effects of the invention can be manifested.

If desired, air or oxygen may be blown into a processing tank or storage tank to enhance the activity of a bleaching solution or bleach-fixer. An oxidizing agent, such as a hydrogen peroxide, a bromate and a persulfate, may be added to a bleaching solution or bleach-fixer if need arises.

Examples of a fixing agent to be contained in a bleach-fixer of the invention include thiocyanates and thiosulfates. The amount of a thiocyanate should preferably be at least 0.1 mol/l; for processing a color negative, the amount of a thiocyanate should preferably be 0.5 mol/l or more, still preferably 1.0 mol/l or more. The amount of a thiosulfate should preferably be at least 0.2 mol/l; for processing a color negative, the amount of a thiosulfate should preferably be 0.5 mol/l or more.

In the invention, a bleach-fixer may contain one or more kinds of pH buffers, which normally consists of a salt. It is desired that a large amount of a rehalogenating agent such as an alkaline halide or ammonium halide, e.g. potassium bromide, sodium bromide, sodium chloride, ammonium bromide, be contained in a bleach-fixer. Also, a compound generally contained in a bleach-fixer such as alkylamines and polyethylene oxides, may be added to a bleach-fixer if the occasion arises.

Silver may be recovered from a bleach-fixer by a known method.

It is preferred that a compound represented by the following formula FA described in Japanese Patent O.P.I. Publication No. 295258/1989, page 56, including example compounds, be added to a bleach-fixer. By doing this, not only can the effects of the invention be manifested successfully, but also only a small amount of sludge will be formed in a bleach-fixer when a few light-sensitive materials are processed for a long period of time.

Formula FA

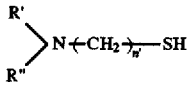

In the above formula, R' and R" are each a hydrogen atom an alkyl group, an aryl group, an aralkyl group or a heterocyclic group; and n' is an integer of 2 or 3.

The following tables show the substituents for formula FA exemplified in Japanese Patent O.P.I. Publication No. 295258/1988:

| No. | R' | R" | n' |
|---|---|---|---|
| FA-1 | iso-$C_3H_7$— | H | 2 |
| FA-2 | n-$C_4H_9$— | H | 2 |
| FA-3 | iso-$C_4H_9$— | H | 2 |
| FA-4 | sec-$C_4H_7$— | H | 2 |
| FA-5 | ter-$C_4H_9$— | H | 2 |
| FA-6 | CH=$CHCH_2$— | H | 2 |
| FA-7 | n-$C_6H_{13}$— | H | 2 |
| FA-8 | n-$C_8H_{17}$— | H | 2 |
| FA-9 | n-$C_{10}H_{21}$— | H | 2 |
| FA-10 | 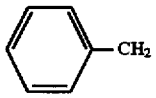 | H | 2 |
| FA-11 | 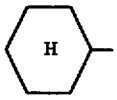 | H | 2 |
| FA-12 | $C_2H_5$— | $C_2H_5$— | 2 |
| FA-13 | n-$C_3H_7$— | n-$C_3H_7$— | 2 |
| FA-14 | iso-$C_3H_7$— | iso-$C_3H_7$— | 2 |
| FA-15 | n-$C_4H_9$— | n-$C_4H_9$— | 2 |
| FA-16 | iso-$C_4H_9$— | iso-$C_4H_9$— | 2 |
| FA-17 | sec-$C_4H_9$— | sec-$C_4H_9$— | 2 |

-continued

| No. | R' | R" | n' |
|---|---|---|---|
| FA-18 | n-$C_5H_{11}$— | n-$C_5H_{11}$— | 2 |
| FA-19 | iso-$C_5H_{11}$— | iso-$C_5H_{11}$— | 2 |
| FA-20 | $CH_2$=CH—$CH_2$— | $CH_2$=$CHCH_2$— | 2 |
| FA-21 | $CH_3$— | $CH_3$— | 2 |
| FA-22 | $HOCH_2CH_2$— | H— | 2 |
| FA-23 | $HOCH_2CH_2$— | $CH_3$— | 2 |
| FA-24 | 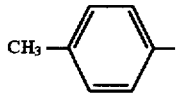 | H— | 2 |
| FA-25 | 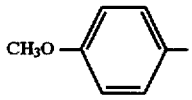 | H— | 2 |
| FA-26 | 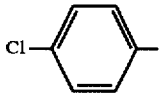 | H— | 2 |
| FA-27 | $C_2H_5$— | $CH_3$— | 2 |
| FA-28 | $C_2H_5$— | $C_3H_7$— | 2 |
| FA-29 | H— | H— | 2 |
| FA-30 | $CH_2$=CH—$CH_2$— | $C_2H_5$— | 2 |
| FA-31 | 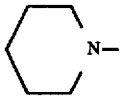 | | 2 |
| FA-32 | 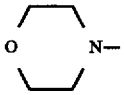 | | 2 |
| FA-33 | 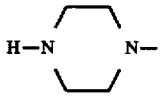 | | 2 |
| FA-34 | 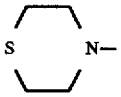 | | 2 |
| FA-35 | 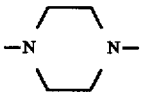 | | 2 |
| FA-36 | 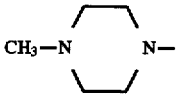 | | 2 |
| FA-37 | $C_2H_2$— | $C_2H_5$— | 3 |
| FA-38 | $HSCH_2CH_2$— | $HSCH_2CH_2$— | 2 |
| FA-39 | $HSCH_2CH_2$— | HOOC—$CH_2$— | 2 |

Those compounds represented by Formula FA may be synthesized in ordinary methods such as those described in, for example, U.S. Pat. Nos. 3,335,161 and 3,260,718. Compounds represented by formula FA may be employed either alone or in combination.

A compound represented by formula FA should be employed preferably in an amount of 0.1 to 200 g per liter of a bleach-fixer.

Bleaching time by a bleaching solution of the invention is not limitative; but preferably 3 minutes and 30 seconds or less, still preferably in the range of 10 seconds to 2 minutes and 20 seconds, most preferably in the range of 20 seconds to 1 minute and 20 seconds. Bleach-fixing time by a bleach-fixer is not limitative either; but preferably 4 minutes or less, still preferably in the range of 10 seconds to 2 minutes and 20 seconds.

In a bleacher or bleach-fixer of the invention, if the amount of ammonium ions accounts for 50 mol % or less of the total amount of cations, the effects of the invention can be manifested successfully, and the unfavorable odor of the liquid can be minimized. The amount of ammonium ions accounts for still preferably 30 mol % or less, most preferably 10 mol % or less, of the combined amount of cations.

EXAMPLES

In the following examples, the amounts of ingredients are grams per square meter of a light-sensitive material, unless otherwise indicated. The amounts of silver halide and colloidal silver were translated into the amounts of silver.

Example 1

Preparation of Silver Halide Color Photographic Material (Color Paper)

One side of a paper support was coated with polyethylene, and the other side thereof was coated with polyethylene that contained titanium oxide. On the titanium oxide-containing polyethylene-coated side of the support, layers of the following compositions were provided in sequence to form a multi-layer color photographic light-sensitive material.

The coating liquid for the 1st layer was prepared by the method described below.

Coating Liquid for 1st Layer

In 6.67 g of a high-boiling solvent (DNP),26.7 g of a yellow coupler (Y-1), 100 g of a dye image stabilizer (ST-1), 6.67 g of another dye image stabilizer (ST-2) and 0.67 g of an additive (HQ-1) were dissolved, to which 60 ml of ethyl acetate had been added. The resulting solution was dispersed in 220 ml of an aqueous 10% gelatin solution containing 7 ml of a 20% surfactant (SU-1) by means of an ultrasonic homogenizer, whereby a yellow coupler dispersion was obtained. This yellow coupler dispersion was mixed with a blue-sensitive silver halide emulsion (silver content: 10 g) which had been prepared by a method described later, thus forming a coating liquid for the 1st layer.

Coating liquids for the 2nd to 7th layers were prepared in a similar manner as mentioned above.

As a hardener, H-1 was added to the 2nd and 4th layers, and H-2 was added to the 7th layer. Also, surfactants SU-2 and SU-3 were added for the adjustment of surface tension.

TABLE 1, TABLE 2

| Layer | Composition | Amount |
|---|---|---|
| 7th layer (protective layer) | Gelatin | 1.0 |
| 6th layer (UV absorbing layer) | Gelatin | 0.35 |
| | UV absorber (UV-1) | 0.10 |

TABLE 1, TABLE 2-continued

| Layer | Composition | Amount |
|---|---|---|
| | UV absorber (UV-2) | 0.04 |
| | UV absorber (UV-3) | 0.18 |
| | Anti-stain agent (HQ-1) | 0.01 |
| | DNP | 0.18 |
| | PVP | 0.03 |
| | Anti-irradiation dye (AI-2) | 0.02 |
| 5th layer (red-sensitive layer) | Gelatin | 1.21 |
| | Red-sensitive silver chlorobromide emulsion (EmC) | 0.19 |
| | Cyan coupler (C-1) | 0.20 |
| | Cyan coupler (C-2) | 0.25 |
| | Dye image stabilizer (ST-1) | 0.20 |
| | Anti-stain agent (HQ-1) | 0.01 |
| | HBS-1 | 0.20 |
| | DOP | 0.20 |
| 4th layer (UV absorbing layer) | Gelatin | 0.90 |
| | UV absorber (UV-1) | 0.28 |
| | UV absorber (UV-2) | 0.08 |
| | UV absorber (UV-3) | 0.38 |
| | Anti-stain agent (HQ-1) | 0.03 |
| | DNP | 0.35 |
| 3rd layer (green-sensitive layer) | Gelatin | 1.40 |
| | Green-sensitive silver chlorobromide emulsion (EmB) | 0.15 |
| | Magenta coupler (M-C) | 0.32 |
| | stabilizer (ST-3) | 0.15 |
| | Dye image stabilizer (ST-4) | 0.15 |
| | Dye image stabilizer (ST-5) | 0.15 |
| | DNP | 0.20 |
| | Anti-irradiation dye (AI-1) | 0.02 |
| 2nd layer (intermediate layer) | Gelatin, | 1.20 |
| | Gelatin, Anti-stain agent (HQ-2) | 0.12 |
| | DIDP | 0.15 |
| 1st layer (blue-sensitive layer) | Gelatin, | 1.20 |
| | Blue-sensitive silver chlorobromide emulsion (EmA) | 0.25 |
| | Yellow coupler (Y-1) | 0.82 |
| | Dye image stabilizer (ST-1) | 0.30 |
| | Dye image stabilizer (ST-2) | 0.20 |
| | Anti-stain agent (HQ-1) | 0.02 |
| | Anti-irradiation agent (AI-3) | 0.02 |
| | DNP | 0.20 |
| Support | Polyethylene-laminated paper | |

Y-1
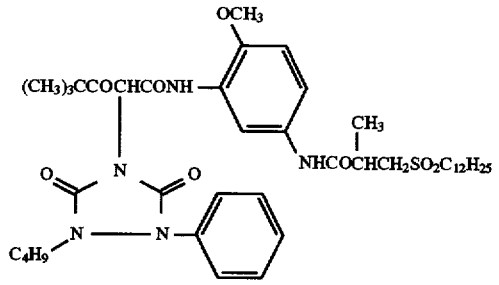
M-C
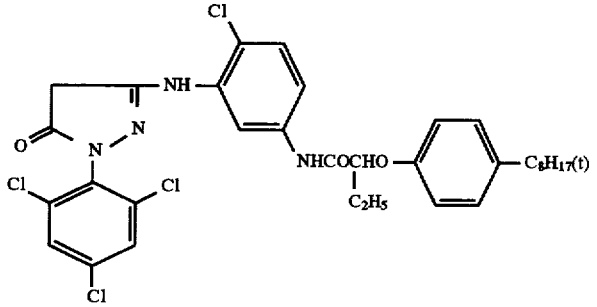
C-1
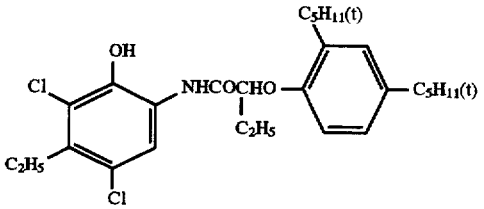
C-2
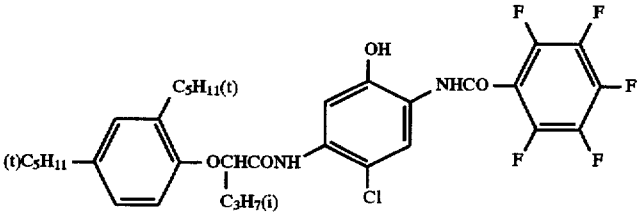
ST-1
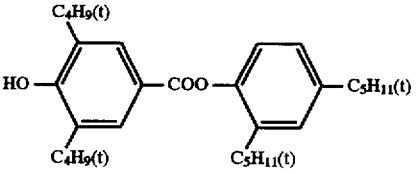
ST-2
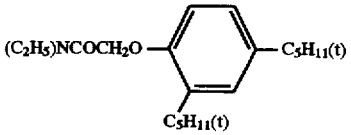
ST-3
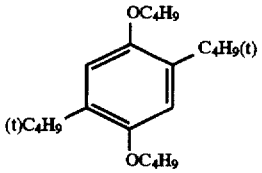
ST-4
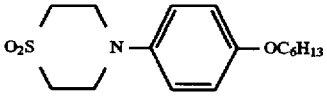

-continued
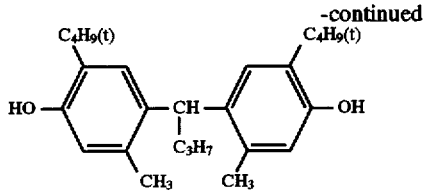
ST-5
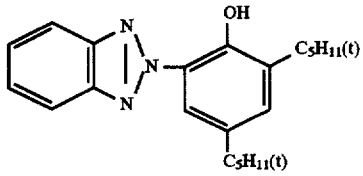
UV-1
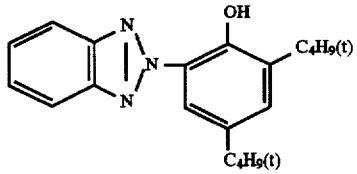
UV-2
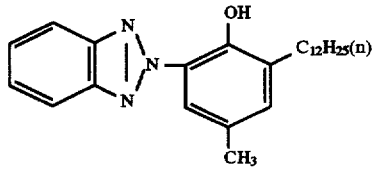
UV-3
DOP: dioctyl phthalate
DNP: dinonyl phthalate
DIDP: diisodecyl phthalate
PVP: polyvinyl pyrrolidone
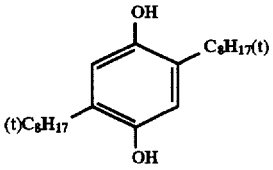
HQ-1
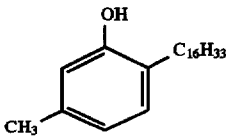
HQ-2
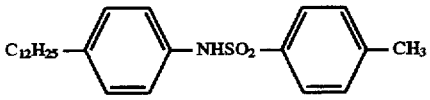
HBS-1
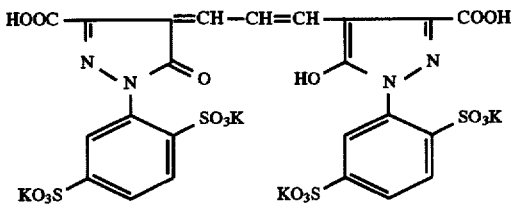
AI-1

-continued

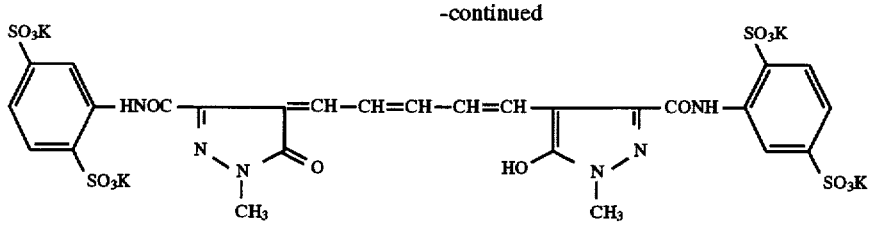

AI-2

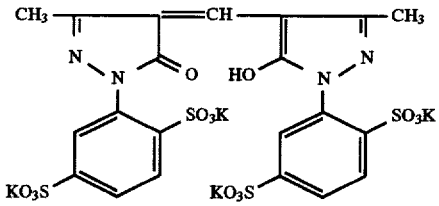

AI-3

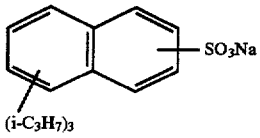

SU-1

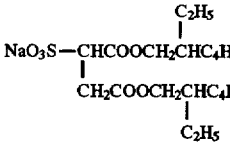

SU-2

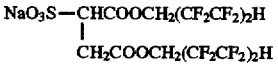

SU-3

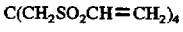

H-1

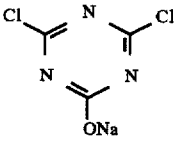

H-2

Preparation of Blue-Sensitive Silver Halide Emulsion

To 1,000 ml of an aqueous 2% gelatin solution that had been heated to 40° C., solutions A and B were added by the double-jet method over a period of 30 minutes, while controlling pAg and pH to 6.5 and 3.0, respectively. Then, solutions C and D were added over a period of 180 minutes while controlling pAg and pH to 7.3 and 5.5, respectively.

pAg control was performed by the method described in Japanese Patent O.P.I. Publication No. 45437/1984, and pH control was conducted by using sulfuric acid or an aqueous solution of sodium hydroxide.

| | |
|---|---|
| (Solution A) | |
| Sodium chloride | 3.42 g |
| Potassium bromide | 0.03 g |
| Water was added to make the total quantity | 200 ml. |
| (Solution B) | |
| Silver nitrate | 10 g |
| Water was added to make the total quantity | 200 ml. |

-continued

| | |
|---|---|
| (Solution C) | |
| Sodium chloride | 102.7 g |
| Potassium bromide | 1.0 g |
| Water was added to make the total quantity | 600 ml. |
| (Solution D) | |
| Silver nitrate | 300 g |

Water was added to make the total quantity 600 ml.

After the addition, the resulting solution was subjected to desilvering with an aqueous 5% solution of Demor N (manufactured by Kao Atlas) and an aqueous 20% solution of magnesium sulfate. Then, the solution was mixed with an aqueous gelatin solution, whereby an emulsion (EMP-1) comprising monodispersed, cubic silver halide grains with an average grain size of 0.85 μm, a variation coefficient ($\sigma/\bar{\gamma}$)of 7% and a silver chloride content of 99.5 mol % was obtained, where $\sigma$ is a standard deviation of grain size distribution and $\bar{\gamma}$ is an average grain size.

The above emulsion was subjected to chemical ripening at 50° C. for 90 minutes using the following compounds, whereby a blue-sensitive silver halide emulsion (Em-A) was obtained.

| | |
|---|---|
| Sodium thiosulfate | 0.8 mg/mol AgX |
| Chloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of Green-Sensitive Silver Halide Emulsion

An emulsion (EMP-2) comprising monodispersed, cubic silver halide grains with an average grain size of 0.43 μm, a variation coefficient of 8% and a silver chloride content of 99.5 mol % was prepared in substantially the same manner as in the preparation of the blue-sensitive silver halide emulsion, except that the time taken in adding solutions A and B and the time taken in adding solutions C and D were changed.

The above emulsion was subjected to chemical ripening at 55° C. for 120 minutes using the following compounds, whereby a green-sensitive silver halide emulsion (Em-B) was obtained.

| | |
|---|---|
| Sodium thiosulfate | 1.5 mg/mol AgX |
| Chloroauric acid | 1.0 mg/mol AgX |

-continued

| | |
|---|---|
| Stabilizer (STAB-1) | $6 \times 10^{-4}$ mol/mol AgX |
| Sensitizing dye (GS-1) | $4 \times 10^{-4}$ mol/mol AgX |

Preparation of Red-Sensitive Silver Halide Emulsion

An emulsion (EMP-3) comprising monodispersed, cubic silver halide grains with an average grain size of 0.50 μm, a variation coefficient of 8% and a silver chloride content of 99.5 mol % was prepared in substantially the same manner as in the preparation of the blue-sensitive silver halide emulsion, except that the time taken in adding solutions A and B and the time taken in adding solutions C and D were changed.

The above emulsion was subjected to chemical ripening at 60° C. for 90 minutes using the following compounds, whereby a red-sensitive silver halide emulsion (Em-C) was obtained.

| | |
|---|---|
| Sodium thiosulfate | 1.8 mg/mol AgX |
| Chloroauric acid | 2.0 mg/mol AgX |
| Stabilizer (STAB-1) | $6 \times 10^{-4}$ mol/mol AgX |
| Sensitizing dye (RS-1) | $4 \times 10^{-4}$ mol/mol AgX |

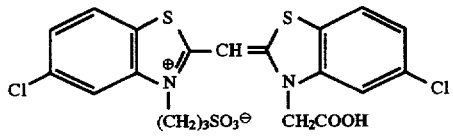

BS-1

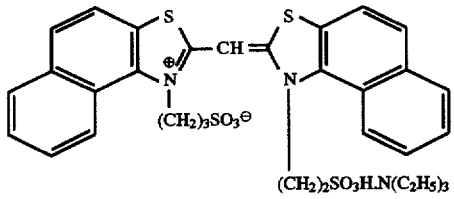

BS-2

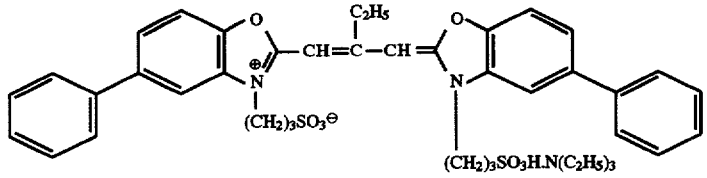

GS-1

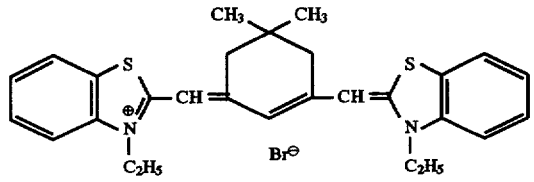

RS-1

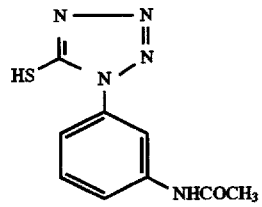

STAB-1

The sample was exposed to light in the usual way, and processed under the following conditions and by using the following processing liquids.

| Processing procedure | Processing temperature | Processing time | Amount of replenisher |
|---|---|---|---|
| (1) Color developing | 35.0 ± 0.3° C. | 45 sec | 162 ml/m$^2$ |
| (2) Bleach-fixing | 35.0 ± 0.5° C. | 45 sec | 100 ml/m$^2$ |
| (3) Stabilizing (3-tank cascade) | 30–34° C. | 90 sec | 248 ml/m$^2$ |
| (4) Drying | 60–80° C. | 30 sec | |

| Color Developer | |
|---|---|
| Triethanolamine | 10 g |
| Ethylene glycol | 6 g |
| N,N-diethylhydroxylamine | 3.6 g |
| Hydrazinodiacetic acid | 5.0 g |
| Potassium bromide | 20 mg |
| Potassium chloride | 2.5 g |
| Diethylenetriaminepentaacetic acid | 5 g |
| Potassium sulfite | $5.0 \times 10^{-4}$ mol |
| Color developing agent, 3-methyl-4-amino-N-ethyl-N-(β-methanesulfonamidethyl)aniline sulfate | 5.5 g |
| Potassium carbonate | 25 g |
| Potassium bicarbonate | 5 g |

Water was added to make the total quantity 1 l, and pH was controlled to 10.10 with potassium hydroxide or sulfuric acid.

| Color Developer Replenisher | |
|---|---|
| Triethanolamine | 14.0 g |
| Ethylene glycol | 8 g |
| N,N-diethylhydroxylamine | 5 g |
| Hydrazinodiacetic acid | 7.5 g |
| Potassium bromide | 8 mg |
| Potassium chloride | 0.3 g |
| Diethylenetriaminepentaacetic acid | 7.5 g |
| Potassium sulfite | $7.0 \times 0^{-4}$ mol |
| Color developing agent, 3-methyl-4-amino-N-ethyl-N-(β-methanesulfonamidethyl)aniline sulfate | 8 g |
| Potassium carbonate | 30 g |
| Potassium bicarbonate | 1 g |

Water was added to make the total quantity 1 l, and pH was adjusted to 10.40 with potassium hydroxide or sulfuric acid.

| Bleach-fixer | |
|---|---|
| Water | 600 ml |
| Ferric complex salt of an organic acid (shown in Tables 3 and 4) | 0.15 mol |
| Thiosulfate | 0.6 mol |
| Sulfite | 0.15 mol |
| 1,3-propanediaminetetraacetic acid | 2 g |

pH was adjusted to 7.0 with aqueous ammonia, potassium hydroxide and acetic acid, and water was added to make the total quantity 1 l.

To adjust the ratio (mol %) of the amount of ammonium ions to the total amount of cations to those shown in Tables 3 and 4, ammonium salts and potassium salts of the above additives were added.

Bleach-Fixer Replenisher

Prepared by increasing the concentration of each component in the bleach-fixer by 1.25 times, and by changing the pH of the bleach-fixer to 5.8.

| Stabilizer and Stabilizer Replenisher | |
|---|---|
| Orthophenyl phenol | 0.1 g |
| Uvitex MST (manufactured by Ciba Geigy) | 1.0 g |
| $ZnSO_4.7H_2O$ | 0.1 g |
| Ammonium sulfite (40% solution) | 5.0 ml |
| 1-Hydroxyethylidene-1,1-diphosphonic acid (60% solution) | 3.0 g |
| Ethylenediaminetetraacetic acid | 1.5 g |

Water was added to make the total quantity to 1 l, and pH was adjusted to 7.8 with aqueous ammonia or sulfuric acid.

The above-obtained color paper sample was subjected to a continuos treatment.

The continuos treatment was run by the method described below: The color developer, the bleach-fixer and the stabilizer were put in their respective tanks, and the above-obtained color paper sample was passed through these tanks. Every three minutes, the color developer replenisher, the bleach-fixer replenisher and the stabilizer replenisher were supplied to the color developer tank, the bleach-fixer tank and the stabilizer tank, respectively, by means of a constant delivery pump.

The continuous treatment was conducted until the amount of the bleach-fixer replenisher supplied to the bleach-fixer tank became three times as large as that of the volume of the bleach-fixer tank. "1R" means that the bleach-fixer replenisher has been supplied to the bleach-fixer tank in an amount equal to the volume of the tank.

After processing, the exposed portion of each sample was divided into two parts. One of which was examined for the amount of remaining silver by X-ray fluorescence. Also, each sample was examined immediately after the completion of the processing for stain formation in the edge portion. The bleach-fixer was visually checked for contamination caused by the formation of an insoluble decomposition product of thiosulfite. The results obtained are summarized in Tables 3 and 4.

Contamination of the bleach-fixer was evaluated according to the following criteria:

A: No sulfide was formed.
B: An extremely small amount of scum was observed.
C: An only small amount of a sulfide was formed.
D: A large amount of a sulfide was formed.
E: An extremely large amount of a sulfide was formed.

Stain formation in the edge portion was evaluated according to the following criteria:

A: No stains were formed.
B: A very small amount of stains were formed.
C: A small amount of stains were formed.
D: A large amount of stains were formed.
E: A very large amount of stains were formed.

TABLE 3

| Experiment No. | Ferric complex salt of an organic acid | Ratio (mol %) of the amount of ammonium ions to the total amount of cations in the bleach-fixer | Amount of remaining silver (mg/100 $cm^2$) | Stain formation in the edge portion | Formation of a sulfide | Remarks |
|---|---|---|---|---|---|---|
| 1-1 | EDTA.Fe | 100 | 0.9 | C | D | Comparative Example |
| 1-2 | EDTA.Fe | 60 | 0.9 | C | D | Comparative Example |
| 1-3 | EDTA.Fe | 50 | 1.0 | C | D | Comparative Example |
| 1-4 | EDTA.Fe | 30 | 1.0 | B | D | Comparative Example |
| 1-5 | EDTA.Fe | 10 | 1.1 | B | D | Comparative Example |
| 1-6 | EDTA.Fe | 0 | 1.2 | B | D | Comparative Example |
| 1-7 | PDTA.Fe | 100 | 1.8 | C | E | Comparative Example |
| 1-8 | PDTA.Fe | 60 | 1.9 | C | E | Comparative Example |
| 1-9 | PDTA.Fe | 50 | 1.9 | B | E | Comparative Example |
| 1-10 | PDTA.Fe | 30 | 2.1 | B | E | Comparative Example |
| 1-11 | PDTA.Fe | 10 | 2.0 | B | E | Comparative Example |
| 1-12 | PDTA.Fe | 0 | 2.2 | B | E | Comparative Example |
| 1-13 | DTPA.Fe | 100 | 0 | E | B | Comparative Example |
| 1-14 | DTPA.Fe | 60 | 0 | E | B | Comparative Example |
| 1-15 | DTPA.Fe | 50 | 0.1 | E | B | Comparative Example |
| 1-16 | DTPA.Fe | 30 | 0.1 | E | B | Comparative Example |
| 1-17 | DTPA.Fe | 10 | 0.2 | D | B | Comparative Example |
| 1-18 | DTPA.Fe | 0 | 0.2 | D | B | Comparative Example |
| 1-19 | NTA.Fe | 100 | 1.3 | C | D | Comparative Example |
| 1-20 | NTA.Fe | 60 | 1.3 | C | D | Comparative Example |
| 1-21 | NTA.Fe | 50 | 1.4 | B | D | Comparative Example |
| 1-22 | NTA.Fe | 30 | 1.5 | B | D | Comparative Example |
| 1-23 | NTA.Fe | 10 | 1.7 | B | D | Comparative Example |
| 1-24 | NTA.Fe | 0 | 1.8 | B | D | Comparative Example |

TABLE 4

| Experiment No. | Ferric complex salt of an organic acid | Ratio (mol %) of the amount of ammonium ions to the total amount of cations in the bleach-fixer | Amount of remaining silver (mg/100 $cm^2$) | Stain formation in the edge portion | Formation of a sulfide | Remarks |
|---|---|---|---|---|---|---|
| 1-25 | (A-1).Fe | 100 | 0 | C | B | Present Invention |
| 1-26 | (A-1).Fe | 60 | 0 | C | B | Present Invention |
| 1-27 | (A-1).Fe | 50 | 0 | B | A | Present Invention |
| 1-28 | (A-1).Fe | 30 | 0 | B | A | Present Invention |

TABLE 4-continued

| Experiment No. | Ferric complex salt of an organic acid | Ratio (mol %) of the amount of ammonium ions to the total amount of cations in the bleach-fixer | Amount of remaining silver (mg/100 $cm^2$) | Stain formation in the edge portion | Formation of a sulfide | Remarks |
|---|---|---|---|---|---|---|
| 1-29 | (A-1).Fe | 10 | 0.1 | A | A | Present Invention |
| 1-30 | (A-1).Fe | 0 | 0.1 | A | A | Present Invention |
| 1-31 | (A-3).Fe | 100 | 0 | C | B | Present Invention |
| 1-32 | (A-3).Fe | 60 | 0 | C | B | Present Invention |
| 1-33 | (A-3).Fe | 50 | 0 | C–B | A | Present Invention |
| 1-34 | (A-3).Fe | 30 | 0.1 | B | A | Present Invention |
| 1-35 | (A-3).Fe | 10 | 0.1 | A | A | Present Invention |
| 1-36 | (A-3).Fe | 0 | 0.2 | A | A | Present Invention |
| 1-37 | (A-10).Fe | 100 | 0.1 | C | B | Present Invention |
| 1-38 | (A-10).Fe | 60 | 0.1 | C | B | Present Invention |
| 1-39 | (A-10).Fe | 50 | 0.1 | C–B | A | Present Invention |
| 1-40 | (A-10).Fe | 30 | 0.1 | B | A | Present Invention |
| 1-41 | (A-10).Fe | 10 | 0.2 | B | A | Present Invention |
| 1-42 | (A-10).Fe | 0 | 0.2 | A | A | Present Invention |

Note: In the preceding tables and following tables, "EDTA Fe" means a ferric complex salt of EDTA. The same can be true of PDTA•Fe, DTPA•Fe, NTA•Fe, (A-1)•Fe, (A-3)•Fe and (A-10)•Fe. EDTA, PDTA, DTPA and NTA are ethylendiaminetetraacetate, 1,3-propylenediaminetetraacetate, diethylentriaminepentaacetate and nitrylotriacetate, respectively.

From Tables 3 and 4, it can be understood that the use of a ferric complex salt of an organic acid according to the invention led to a decreased amount of remaining silver, a decreased amount of stains formed in the edge portion, and improved storage stability of the bleach-fixer. Such effects were produced more noticeably when the ratio of the amount of ammonium ions to the total amount of cations was 50 mol % or less. Still more satisfactory results were obtained at 30 mol % or less, and the best results were obtained at 10 mol % or less.

The same experiment as mentioned above was conducted, except that (A-4)•Fe, (A-5)•Fe, (A-14)•Fe and (A-16)•Fe were used instead of (A-3)•Fe. Results obtained were similar to those obtained with (A-3)•Fe.

Example 2

A silver iodobromide color photographic light-sensitive material was prepared by the method described below.

Preparation of Silver Iodobromide Color Photographic Light-Sensitive Material One side of a triacetyl cellulose film support (thickness: 60 μm) was subbed. On the other side of the support, layers of the following compositions were provided in sequence.

| | |
|---|---|
| 1st layer | |
| Alumina sol AS-100 (aluminum oxide) (manufactured by Nissan Chemical Co., Ltd.) | 0.8 g |
| 2nd layer | |
| Diacetyl cellulose | 100 mg |
| Stearic acid | 10 mg |
| Finely divided silica (average particle size: 0.2 μm) | 50 mg |

On the subbed side of the support, layers of the following compositions were provided in sequence, whereby a multilayer color photographic light-sensitive material (Sample No. a-1) was obtained.

| | |
|---|---|
| 1st layer: Anti-halation layer (HC) | |
| Black colloidal silver | 0.15 g |
| UV absorber (UV-1) | 0.20 g |
| Colored cyan coupler (CC-1) | 0.02 g |
| High-boiling solvent (Oil-1) | 0.20 g |
| High-boiling solvent (Oil-2) | 0.20 g |
| Gelatin | 1.6 g |
| 2nd layer: Intermediate layer (IL-1) | |
| Gelatin | 1.3 g |
| 3rd layer: Low-speed red-sensitive emulsion layer (R-L) | |
| Silver iodobromide emulsion (average grain size: 0.3 μm) | 0.4 g |
| Silver iodobromide emulsion (average grain size: 0.4 μm) | 0.3 g |
| Sensitizing dye (S-1) | $3.0 \times 10^{-4}$ mol/mol silver |
| Sensitizing dye (S-2) | $3.2 \times 10^{-4}$ mol/mol silver |
| Sensitizing dye (S-3) | $0.3 \times 10^{-4}$ mol/mol silver |

-continued

| | |
|---|---|
| Cyan coupler (C-1) | 0.50 g |
| Cyan coupler (C-2) | 0.20 g |
| Colored cyan coupler (CC-1) | 0.07 g |
| DIR compound (D-1) | 0.006 g |
| DIR compound (D-2) | 0.01 g |
| High-boiling solvent (Oil-1) | 0.55 g |
| Gelatin | 1.0 g |
| 4th layer: High-speed red-sensitive emulsion layer (R-H) | |
| Silver iodobromide emulsion (average grain size: 0.7 μm) | 0.9 g |
| Sensitizing dye (S-1) | $1.7 \times 10^{-4}$ mol/mol silver |
| Sensitizing dye (S-2) | $1.6 \times 10^{-4}$ mol/mol silver |
| Sensitizing dye (S-3) | $0.2 \times 10^{-4}$ mol/mol silver |
| Cyan coupler (C-2) | 0.23 g |
| Colored cyan coupler (CC-1) | 0.03 g |
| DIR compound (D-2) | 0.02 g |
| High-boiling solvent (Oil-1) | 0.30 g |
| Gelatin | 1.0 g |
| 5th layer: Intermediate layer (IL-2) | 0.8 g |
| Gelatin | |
| 6th layer: Low-speed green-sensitive emulsion layer (G-L) | |
| Silver iodobromide emulsion (average grain size: 0.4 μm) | 0.6 g |
| Silver iodobromide emulsion (average grain size: 0.3 μm) | 0.2 g |
| Sensitizing dye (S-4) | $6.7 \times 10^{-4}$ mol/mol silver |
| Sensitizing dye (S-5) | $1.0 \times 10^{-4}$ mol/mol silver |
| Magenta coupler (M-A) | 0.20 g |
| Magenta coupler (M-B) | 0.40 g |
| Colored magenta coupler (CM-1) | 0.10 g |
| DIR compound (D-3) | 0.02 g |
| High-boiling solvent (Oil-2) | 0.7 g |
| Gelatin | 1.0 g |
| 7th layer: High-speed green-sensitive emulsion layer (G-H) | |
| Silver iodobromide emulsion (average grain size: 0.7 μm) | 0.9 g |
| Sensitizing dye (S-6) | $1.1 \times 10^{-4}$ mol/mol silver |
| Sensitizing dye (S-7) | $2.0 \times 10^{-4}$ mol/mol silver |
| Sensitizing dye (S-8) | $0.5 \times 10^{-4}$ mol/mol silver |
| Magenta coupler (M-A) | 0.5 g |
| Magenta coupler (M-B) | 0.13 g |
| Colored magenta coupler (CM-1) | 0.04 g |
| DIR compound (D-3) | 0.094 g |
| High-boiling solvent (Oil-2) | 0.35 g |
| Gelatin | 1.0 g |
| 8th layer: Yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High-boiling solvent (Oil-2) | 0.15 g |

-continued

| | |
|---|---|
| Gelatin | 0.9 g |
| 9th layer: Low-speed blue-sensitive emulsion layer (B-H) | |
| Silver iodobromide emulsion (average grain size: 0.3 μm) | 0.25 g |
| Silver iodobromide emulsion (average grain size: 0.4 μm) | 0.25 g |
| Sensitizing dye (S-9) | $5.8 \times 10^{-4}$ mol/mol silver |
| Yellow coupler (Y-1) | 0.71 g |
| Yellow coupler (Y-2) | 0.30 g |
| DIR compound (D-1) | 0.003 g |
| DIR compound (D-2) | 0.006 g |
| High-boiling solvent (Oil-2) | 0.18 g |
| Gelatin | 1.2 g |
| 10th layer: High-speed blue-sensitive emulsion layer (B-H) | |
| Silver iodobromide emulsion (average grain size: 0.8 μm) | 0.5 g |
| Sensitizing dye (S-10) | $3 \times 10^{-4}$ mol per mol silver |
| Sensitizing dye (S-11) | $1.2 \times 10^{-4}$ mol per mol silver |
| Yellow coupler (Y-1) | 0.18 g |
| Yellow coupler (Y-2) | 0.20 g |
| High-boiling solvent (Oil-2) | 0.05 g |
| Gelatin | 0.9 g |
| 11th layer: 1st protective layer (PRO-1) | |
| Silver iodobromide emulsion (average grain size: 0.08 μm) | 0.3 g |
| UV absorber (UV-1) | 0.07 g |
| UV absorber (UV-2) | 0.10 g |
| Additive (HS-1) | 0.2 g |
| Additive (HS-2) | 0.1 g |
| High-boiling solvent (Oil-1) | 0.07 g |
| High-boiling solvent (Oil-3) | 0.07 g |
| Gelatin | 0.85 g |
| 12th layer: 2nd protective layer (PRO-2) | |
| Compound A | 0.04 g |
| Compound B | 0.004 g |
| Polymethyl methacrylate (average grain size: 3 μm) | 0.02 g |

A copolymer of methyl methacrylate, ethylmethacrylate and methacrylic acid (weight ratio:3:3:4; average grain size: 3 μm) 0.13 g The above-obtained color photographic light-sensitive material further contained compounds Su-1 and Su-2, a viscosity controller, hardeners H-1 and H-2, stabilizer ST-1, anti-foggants AF-1 and AF-2 (one with a weight average molecular weight of 10,000 and the other 1,100,000), dyes AI-1 and AI-2 and compound D-1 (9.4 mg/m$^2$).

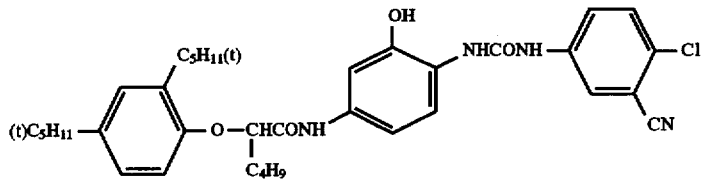

C-1

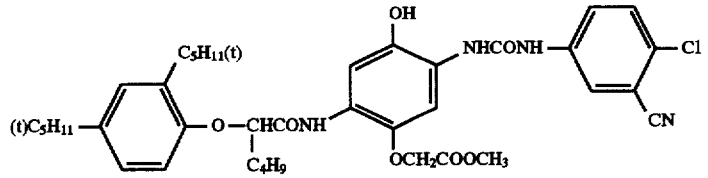

C-2

-continued
M-A
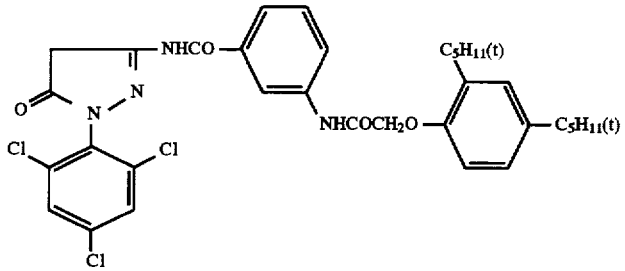
M-B
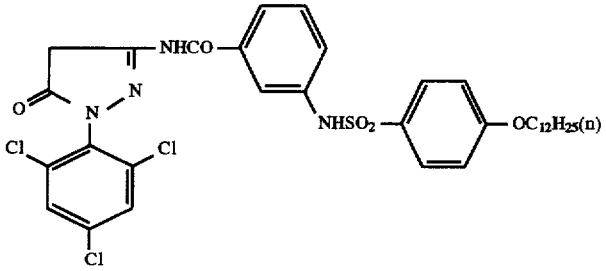
Y-1
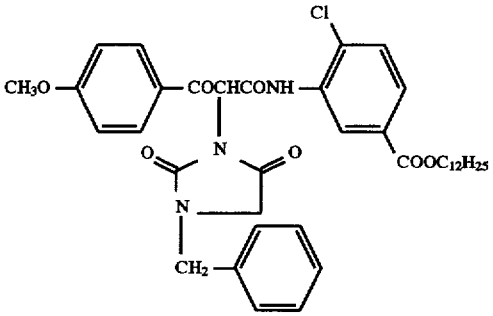
Y-2
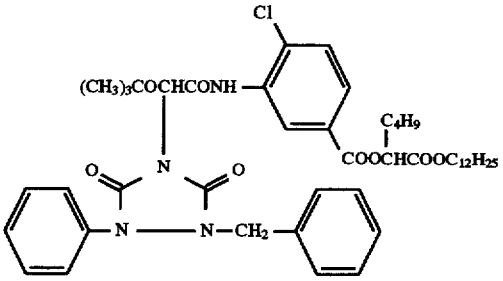
CC-1
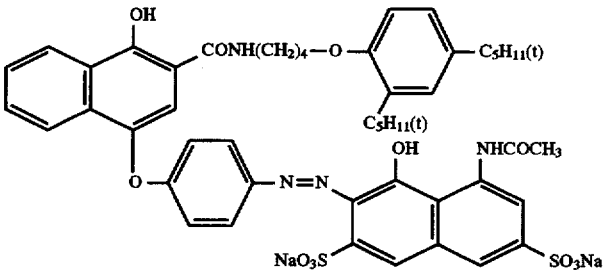

-continued
CM-1
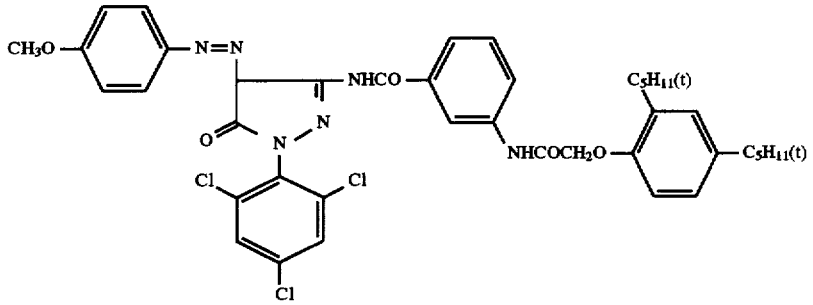
D-1
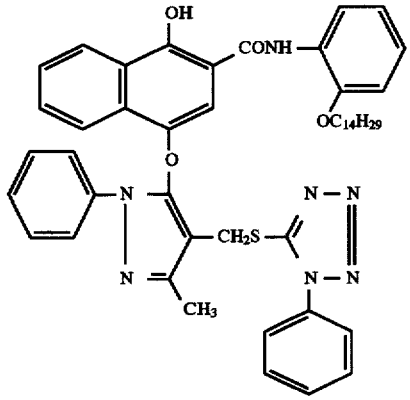
D-2
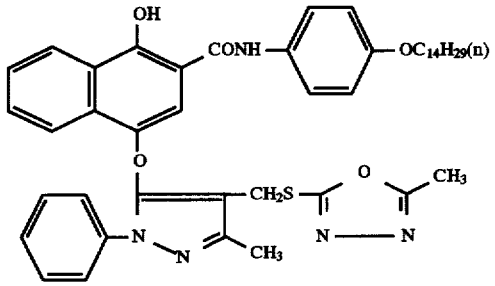
D-3
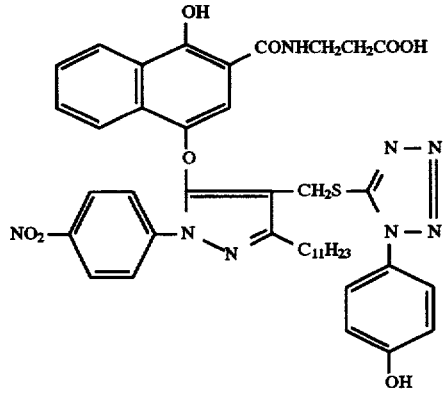
UV-1
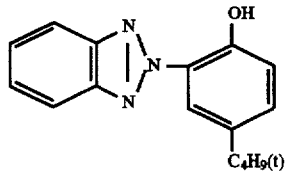

-continued
UV-2
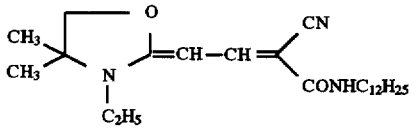
S-1
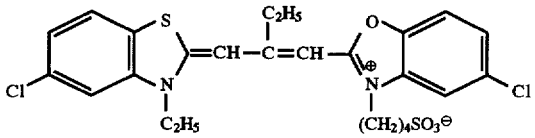
S-2
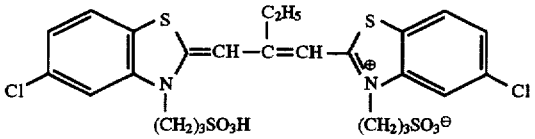
S-3
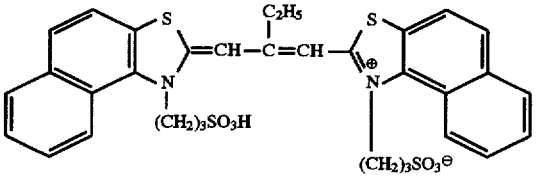
S-4
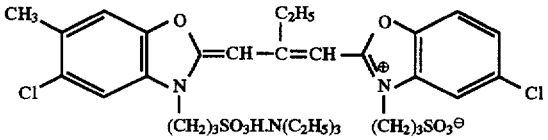
S-5
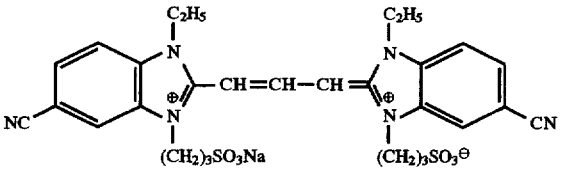
S-6
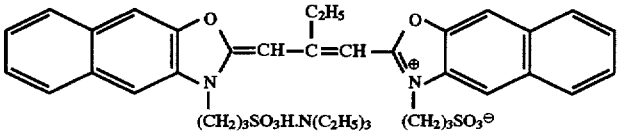
S-7
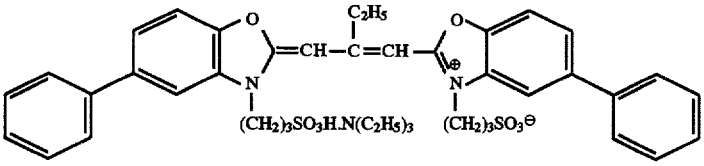
S-8
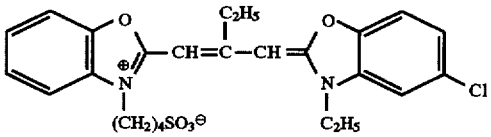
S-9
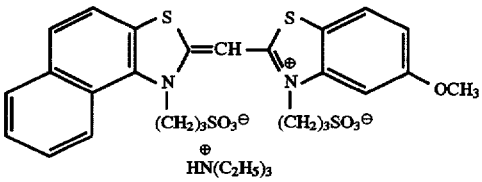

-continued
S-10
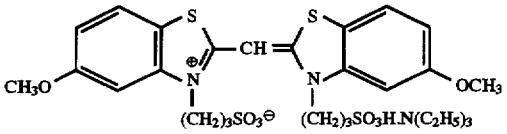
S-11
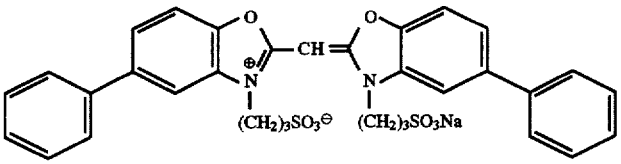
HS-1
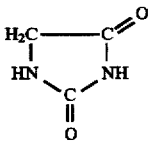
HS-2
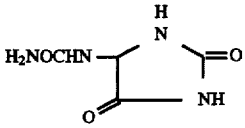
SC-1
Mixture of (2:3)
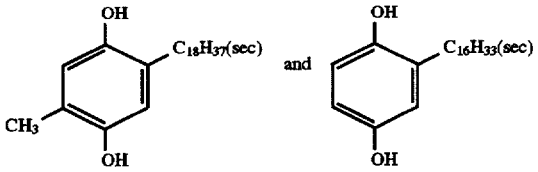
Oil-1
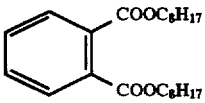
Oil-2
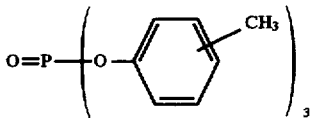
Oil-3
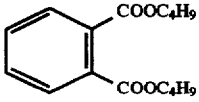
H-1
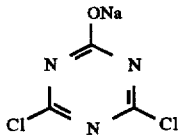
H-2
$(CH_2{=}CHSO_2CH_2)_2O$
SU-1
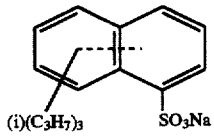
SU-2
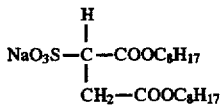

-continued

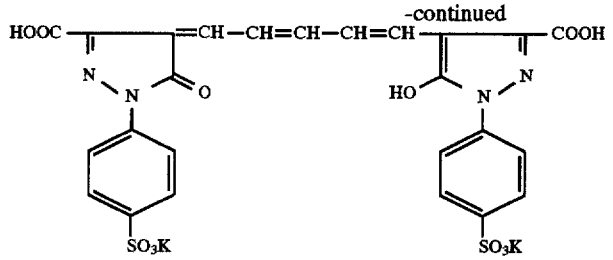

AI-1

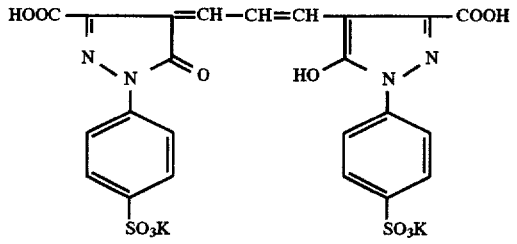

AI-2

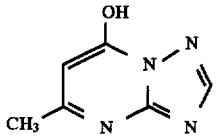

ST-1

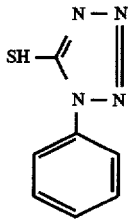

AF-1

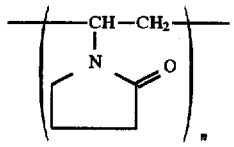

AF-2

Compound A,

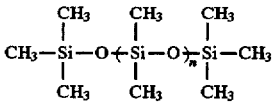

weight average molecular weight: 30,000,

Compound B

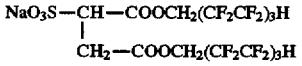

DI-1 (a mixture of the following three components)

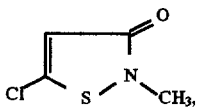

(Component A)

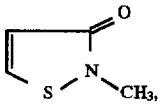

(Component B)

-continued

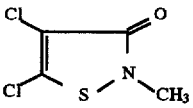

(Component C)

Component A: Component B: Component C=50:23:20 (molar/ratio)

Preparation of Emulsion

A silver iodobromide emulsion in the 10th layer was prepared by the following method.

Monodispersed silver bromide emulsion grains (average grain size: 0.33 μm; silver iodide content: 2 mol %) to be used as seed grains were prepared.

To solution G-1 that had been kept at 70° C., pAg 7.8 and pH 7.0, respectively, the seed grains in the amount equivalent to 0.34 mol were added while sufficiently stirring.

Solutions H-1 and S-1 were added by the double-jet method over a period of 86 minutes at increasing flow rates such that the flow rates immediately after the start of the addition would be 3.6 times as high as those immediately before the completion of the addition. During the addition, the ratio of the flow rate of H-1 to that of S-1 was kept at 1:1. As a result, a high-iodide-containing phase or core phase of grain inner was formed.

Then, while controlling pAg and pH to 10.1 and 6.0, respectively, solutions H-2 and S-2 were added by the double-jet method over a period of 65 minutes at increasing flow rates such that the flow rates immediately after the start of the addition would be 5.2 times as high as those immediately before the completion of the addition. During the addition, the ratio of the flow rate of H-2 to that of S-2 was kept at 1:1. As a result, a low-iodide containing outer phases or shell phase of grain was formed.

During the addition, pAg and pH were controlled with an aqueous solution of potassium bromide and an aqueous 56% solution of acetic acid. The formed grains were washed with water with the conventional flocculation method. Then, gelatin was added to make the grains redispersed. pH and pAg were adjusted to 5.8 and 8.06, respectively, at 40° C.

The resulting emulsion consisted of monodispersed octahedral silver iodobromide grains with an average grain size of 0.80 μm, a variation coefficient of 12.4% and a silver iodide content of 9.0 mol %.

| | |
|---|---|
| Solution G-1 | |
| Ossein gelatin | 100.0 g |
| 10 wt % methanol solution of compound 1 | 25.0 ml |
| 28% aqueous ammonia solution | 440.0 ml |
| 56% aqueous acetic acid solution | 660.0 ml |
| Water was added to make the total quantity | 5000.0 ml. |
| Solution H-1 | |
| Ossein gelatin | 82.4 g |
| Potassium bromide | 151.6 g |
| Potassium iodide | 90.6 g |
| Water was added to make the total quantity | 1030.5 ml. |
| Solution S-1 | |
| Silver nitrate | 309.2 g |
| 28% aqueous ammonia solution | Equivalent amount |
| Water was added to make the total quantity | 1030.5 ml. |
| Solution H-2 | |
| Ossein gelatin | 302.1 g |
| Potassium bromide | 770.0 g |
| Potassium iodide | 33.2 g |
| Water was added to make the total quantity | 3776.8 ml. |
| Solution S-2 | 1133.0 g |
| Silver nitrate | |
| 28% aqueous ammonia solution | Equivalent amount |
| Water was added to make the total quantity | 3776.8 ml. |

$$HO(CH_2CH_2O)_m(\overset{\overset{\displaystyle CH_3}{|}}{C}HCH_2O)_{17}(CH_2CH_2O)_nH$$

Average molecular weight≈1300

Emulsions differing in average grain size and silver iodide content were prepared in substantially the same manner as mentioned above, except that the average size of seed grains, temperature, pAg, pH, flow rate, addition time and halide composition were varied.

Each of the resulting emulsions comprised of monodispersed core/shell type grains with a variation coefficient of 20% or less. Each emulsion was chemically ripen to an optimum level in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added to each emulsion.

The light-sensitive material was exposed to light through an optical wedge in the usual way, and then subjected to a continuous treatment according to the following procedure and by using the following processing liquids. The continuous treatment was run until the amount of the bleach-fixer replenisher supplied doubled the volume of the bleach-fixer tank.

| Processing procedure | Processing time | Processing temperature | Amount of replenisher (amount per 135-size film for 24 exposures) |
|---|---|---|---|
| Color developing | 3 min. 15 sec. | 38° C. | 20 ml |
| Bleach-fixing | 3 min. 15 sec. | 38° C. | 30 ml |
| Stabilizing (3-tank cascade) | 1 min | 38° C. | 40 ml |
| Drying | 1 min | 40–80° C. | |

| Color Developer | |
|---|---|
| Potassium carbonate | 30 g |
| Sodium bicarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl) aniline sulfate | 4.5 g |
| Diethylenetriaminepentaacetic acid | 3.0 g |
| Potassium hydroxide | 1.2 g |

Water was added to make the total quantity 1 l, and pH was adjusted to 10.00 with potassium hydroxide or 20% sulfuric acid.

| Color Developer Replenisher | |
|---|---|
| Potassium carbonate | 35 g |
| Sodium bicarbonate | 3 g |
| Potassium sulfite | 5 g |
| Sodium bromide | 0.5 g |
| Hydroxylamine sulfate | 3.5 g |
| 4-Amino-3-methyl-N-ethyl-(β-hydroxylethyl) aniline sulfate | 6.0 g |
| Potassium hydroxide | 2 g |
| Diethylenetriaminepentaacetic acid | 3.0 g |

Water was added to make the total quantity 1 l, and pH was adjusted to 10.12 with potassium hydroxide or 20% sulfuric acid.

| Bleach-Fixer | |
|---|---|
| Ferric complex salt of an organic acid (shown in Tables 5 and 6) | 0.3 mol |
| Thiosulfate | 2.0 mol |
| Sulfite | 0.15 mol |
| 1,3-propanediaminetetraacetic acid | 2 g |

Water was added to make the total quantity 1 l, and pH was adjusted to 7.0 with aqueous ammonia or sulfuric acid.

To adjust the ratio (mol %) of the amount of ammonium ions to the total amount of cations to those shown in Tables 5 and 6, ammonium salts and potassium salts of the above additives were employed.

Bleach-Fixer Replenisher

Prepared by increasing the concentration of each of the components of the bleach-fixer by 1.07 times, and by adjusting the pH to 6.3.

| Stabilizer and Stabilizer Replenisher | |
|---|---|
| Hexamethylenetetramine | 5 g |
| Diethylene glycol | 10 g |
| 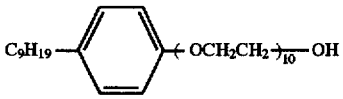 | 1 g |

Water was added to make the total quantity 1 l, and pH was adjusted to 8.0 with KOH.

After the treatment, the light-sensitive material was examined for the amount of remaining silver, and the bleach-fixer was examined for the formation of an insoluble decomposition product of thiosulfite. These examinations were conducted by the same method as in Example 1.

The results obtained are shown in Tables 5 and 6.

TABLE 5

| Experiment No. | Ferric complex salt of an organic acid | Ratio (mol %) of the amount of ammonium ions to the total amount of cations in the bleach-fixer | Amount of remaining silver (mg/100 $cm^2$) | Formation of an insoluble product | Remarks |
|---|---|---|---|---|---|
| 2-1 | EDTA.Fe | 100 | 5.0 | D | Comparative Example |
| 2-2 | EDTA.Fe | 60 | 5.0 | D | Comparative Example |
| 2-3 | EDTA.Fe | 50 | 5.2 | D | Comparative Example |
| 2-4 | EDTA.Fe | 30 | 5.2 | D | Comparative Example |
| 2-5 | EDTA.Fe | 10 | 5.3 | D | Comparative Example |
| 2-6 | EDTA.Fe | 0 | 5.4 | D | Comparative Example |
| 2-5 | PDTA.Fe | 100 | 0 | E | Comparative Example |
| 2-8 | PDTA.Fe | 60 | 0 | E | Comparative Example |
| 2-9 | PDTA.Fe | 50 | 0.1 | E | Comparative Example |
| 2-10 | PDTA.Fe | 30 | 0.1 | E | Comparative Example |
| 2-11 | PDTA.Fe | 10 | 0.2 | E | Comparative Example |
| 2-12 | PDTA.Fe | 0 | 0.2 | E | Comparative Example |
| 2-13 | DTPA.Fe | 100 | 4.5 | C | Comparative Example |
| 2-14 | DTPA.Fe | 60 | 4.5 | C | Comparative Example |
| 2-15 | DTPA.Fe | 50 | 4.7 | B | Comparative Example |
| 2-16 | DTPA.Fe | 30 | 4.7 | B | Comparative Example |
| 2-17 | DTPA.Fe | 10 | 4.9 | B | Comparative Example |
| 2-18 | DTPA.Fe | 0 | 5.0 | B | Comparative Example |
| 2-19 | NTA.Fe | 100 | 5.8 | D | Comparative Example |
| 2-20 | NTA.Fe | 60 | 5.8 | D | Comparative Example |
| 2-21 | NTA.Fe | 50 | 6.0 | D | Comparative Example |
| 2-22 | NTA.Fe | 30 | 6.1 | D | Comparative Example |
| 2-23 | NTA.Fe | 10 | 6.2 | D | Comparative Example |
| 2-24 | NTA.Fe | 0 | 6.3 | D | Comparative Example |

TABLE 6

| Experiment No. | Ferric complex salt of an organic acid | Ratio (mol %) of the amount of ammonium ions to the total amount of cations in the bleach-fixer | Amount of remaining silver (mg/100 $cm^2$) | Formation of an insoluble product | Remarks |
|---|---|---|---|---|---|
| 2-25 | (A-1).Fe | 100 | 0 | B | Present Invention |
| 2-26 | (A-1).Fe | 60 | 0 | B | Present Invention |
| 2-27 | (A-1).Fe | 50 | 0 | A | Present Invention |
| 2-28 | (A-1).Fe | 30 | 0 | A | Present Invention |
| 2-29 | (A-1).Fe | 10 | 0.1 | A | Present Invention |
| 2-30 | (A-1).Fe | 0 | 0.2 | A | Present Invention |
| 2-31 | (A-3).Fe | 100 | 0 | B | Present Invention |
| 2-32 | (A-3).Fe | 60 | 0 | B | Present Invention |
| 2-33 | (A-3).Fe | 50 | 0 | A | Present Invention |
| 2-34 | (A-3).Fe | 30 | 0.1 | A | Present Invention |
| 2-35 | (A-3).Fe | 10 | 0.2 | A | Present Invention |
| 2-36 | (A-3).Fe | 0 | 0.2 | A | Present Invention |
| 2-37 | (A-10).Fe | 100 | 0.1 | B | Present Invention |
| 2-38 | (A-10).Fe | 60 | 0.1 | B | Present Invention |
| 2-39 | (A-10).Fe | 50 | 0.1 | A | Present Invention |
| 2-40 | (A-10).Fe | 30 | 0.2 | A | Present Invention |
| 2-41 | (A-10).Fe | 10 | 0.4 | A | Present Invention |
| 2-42 | (A-10).Fe | 0 | 0.4 | A | Present Invention |

In Tables 5 and 6, EDTA Fe means a ferric complex salt of EDTA. The same can be applied to PDTA Fe, DTPA Fe, NTA Fe, (A-1) Fe, (A-3) Fe and (A-10) Fe.

It is understood from Tables 5 and 6 that the use of a ferric complex salt of a compound of the invention led to a decreased amount of remaining silver and improved storage stability of the bleach-fixer. When the ratio of the amount of ammonium ions to the total amount of cations was 50 mol % or more, the above effects were produced successfully. These effects were produced more successfully at 30 mol % or less, most successfully at 10 mol % or less.

Example 3

An experiment was conducted in substantially the same manner as in Example 2, except that the compositions of the bleaching solution and the fixer were varied to those shown below, and that the treatment was continued until the amount of the bleacher replenisher became 2 rounds under a condition that the treatment for a day was limited to 0.05 rounds of bleaching solution.

| Processing procedure | Processing time | Processing temperature | Amount of replenisher (amount per 135-size film for 24 exposures) |
|---|---|---|---|
| (1) Color developing (1 tank) | 3 min 15 sec | 38° C. | 20 ml |
| (2) Bleaching (1 tank) | 45 sec | 38° C. | 5 ml |
| (3) Fixing (1 tank) | 1 min 30 sec | 38° C. | 33 ml |
| (4) Stabilizing (3 tank cascade) | 1 min | 38° C. | 40 ml |
| (5) Drying (40–80° C.) | 1 min | | |

Bleaching solution

| | |
|---|---|
| Ferric complex salt of an organic acid (shown in Tables 7 and 8) | 0.3 mol |
| Ethylenediaminetetraacetic acid | 10 g |
| Salt of a bromide | 1.3 mol |
| Glacial acetic acid | 50 ml |

Water was added to make the total quantity 1 l, and pH was adjusted to 4.5 with aqueous ammonia or acetic acid.

To adjust the ratio (mol %) of the amount of ammonium ions to the total amount of cations to those shown in Tables 7 and 8, ammonium salts and potassium salts of the above additives were added.

Bleaching Solution Replenisher

Prepared by increasing the concentration of each of the components of the bleaching solution by 1.2 times, and by adjusting the pH to 3.5.

| Fixer and Fixer Replenisher | |
|---|---|
| Ammonium thiosulfate (70% solution) | 350 ml |
| Anhydrous sodium bisulfite | 12 g |
| Sodium metabisulfite | 2.5 g |
| Sodium ethylenediaminetetraacetate | 0.5 g |

Water was added to make the total quantity 1 l, pH was adjusted to 6.5 with acetic acid or aqueous ammonia.

After the processing, the magenta transmission density (density measured by green light) of the unexposed portion of the sample was measured. Also, the amount of remaining silver in the exposed portion was examined by X-ray fluorescence.

The results obtained are shown in Tables 7 and 8.

TABLE 7

| Experiment No. | Ferric complex salt of an organic acid | Ratio (mol %) of the amount of ammonium ions to the total amount of cations in the bleach-fixer | Amount of remaining silver (mg/100 $cm^2$) | Magenta transmission density of unexposed portion | Remarks |
|---|---|---|---|---|---|
| 3-1 | EDTA.Fe | 100 | 7.5 | 0.57 | Comparative Example |
| 3-2 | EDTA.Fe | 60 | 7.5 | 0.57 | Comparative Example |
| 3-3 | EDTA.Fe | 50 | 7.7 | 0.56 | Comparative Example |
| 3-4 | EDTA.Fe | 30 | 7.7 | 0.56 | Comparative Example |
| 3-5 | EDTA.Fe | 10 | 7.9 | 0.56 | Comparative Example |
| 3-6 | EDTA.Fe | 0 | 7.9 | 0.56 | Comparative Example |
| 3-7 | PDTA.Fe | 100 | 0 | 0.63 | Comparative Example |
| 3-8 | PDTA.Fe | 60 | 0 | 0.63 | Comparative Example |
| 3-9 | PDTA.Fe | 50 | 0.1 | 0.61 | Comparative Example |
| 3-10 | PDTA.Fe | 30 | 0.1 | 0.61 | Comparative Example |
| 3-11 | PDTA.Fe | 10 | 0.3 | Q.60 | Comparative Example |
| 3-12 | PDTA.Fe | 0 | 0.3 | 0.60 | Comparative Example |
| 3-13 | DTPA.Fe | 100 | 6.8 | 0.58 | Comparative Example |
| 3-14 | DTPA.Fe | 60 | 6.8 | 0.58 | Comparative Example |
| 3-15 | DTPA.Fe | 50 | 6.9 | 0.57 | Comparative Example |
| 3-16 | DTPA.Fe | 30 | 6.9 | 0.57 | Comparative Example |
| 3-17 | DTPA.Fe | 10 | 7.0 | 0.56 | Comparative Example |
| 3-18 | DTPA.Fe | 0 | 7.0 | 0.56 | Comparative Example |
| 3-19 | NTA.Fe | 100 | 8.5 | 0.58 | Comparatiye Example |
| 3-20 | NTA.Fe | 60 | 8.5 | 0.58 | Comparative Example |
| 3-21 | NTA.Fe | 50 | 8.8 | 0.57 | Comparative Example |
| 3-22 | NTA.Fe | 30 | 8.8 | 0.57 | Comparative Example |
| 3-23 | NTA.Fe | 10 | 9.1 | 0.57 | Comparative Example |
| 3-24 | NTA.Fe | 0 | 9.2 | 0.57 | Comparative Example |

TABLE 8

| Experiment No. | Ferric complex salt of an organic acid | Ratio (mol %) of the amount of ammonium ions to the total amount of cations in the bleach-fixer | Amount of remaining silver (mg/100 $cm^2$) | Magenta transmission density of unexposed portion | Remarks |
|---|---|---|---|---|---|
| 3-25 | (A-1).Fe | 100 | 0 | 0.58 | Present Invention |
| 3-26 | (A-1).Fe | 60 | 0 | 0.58 | Present Invention |
| 3-27 | (A-1).Fe | 50 | 0 | 0.57 | Present Invention |
| 3-28 | (A-1).Fe | 30 | 0 | 0.57 | Present Invention |
| 3-29 | (A-1).Fe | 10 | 0.1 | 0.56 | Present Invention |
| 3-30 | (A-1).Fe | 0 | 0.2 | 0.56 | Present Invention |
| 3-31 | (A-3).Fe | 100 | 0 | 0.58 | Present Invention |
| 3-32 | (A-3).Fe | 60 | 0 | 0.58 | Present Invention |
| 3-33 | (A-3).Fe | 50 | 0 | 0.57. | Present Invention |
| 3-34 | (A-3).Fe | 30 | 0.1 | 0.57 | Present Invention |
| 3-35 | (A-3).Fe | 10 | 0.2 | 0.56 | Present Invention |
| 3-36 | (A-3).Fe | 0 | 0.2 | 0.56 | Present Invention |
| 3-37 | (A-10).Fe | 100 | 0.1 | 0.58 | Present Invention |
| 3-38 | (A-10).Fe | 60 | 0.1 | 0.58 | Present Invention |
| 3-39 | (A-10).Fe | 50 | 0.1 | 0.57 | Present Invention |
| 3-40 | (A-10).Fe | 30 | 0.2 | 0.57 | Present Invention |
| 3-41 | (A-10).Fe | 10 | 0.4 | 0.56 | Present Invention |
| 3-42 | (A-10).Fe | 0 | 0.4 | 0.56 | Present Invention |

As is understood from Tables 7 and 8, the use of a ferric complex salt of an organic acid of the invention resulted in a decrease in the amount of remaining silver and an only slight increase in the magenta transmittance density of the unexposed portion. The above effects were produced successfully when the ratio of the amount of ammonium ions to the total amount of cations was 50 mol % or less, more successfully at 30 mol % or less, and most successfully at 10 mol % or less.

Example 4

Conventional photographic chelating agents such as ethylenediaminetetraacetic acid (EDTA), diethylenetriaminepentaacetic acid (DTPA), N-hydroxyethylethylenediaminetriacetic acid (HEDTA), example compounds A-1, A-3 and A-9 were subjected to the 301C amended MITI test prescribed in the OECD chemicals test guideline (adopted as of May 12, 1981) for the examination of biodegradability.

The results obtained revealed that ferric complex salts of the chelating agents according to the present invention were extremely improved in biodegradability, while those of EDTA, DTPA and HEDTA were poor in biodegradability. The use of ferric complex salts of EDTA, DTPA and HEDTA is, therefore, unfavorable from the viewpoint of environmental protection.

Example 5

Preparation of Emulsion

An aqueous solution containing, per 60 g of silver nitrate, 23.9 mg of a potassium salt of pentabromorhodium, sodium chloride and potassium bromide and an aqueous solution of silver nitrate were added at 40° C. to an aqueous gelatin solution by the double-jet method over a period of 25 minutes, whereby a silver chlorobromide emulsion with an average grain size of 0.20 μm and a silver bromide content of 2 mol % was obtained.

To this emulsion, 200 mg of 6-methyl-4-hydroxy-1,3,3a,7-tetrazaindene was added as a stabilizer, followed by rinsing and desalting.

Then, 20 mg of 6-methyl-4-hydroxy-1,3,3a,7-tetraazaindene was added, and the emulsion was subjected to sulfur sensitization. After the sensitization, gelatin and 6-methyl-4-hydroxy-1,3,3a,7-tetraazaindene (stabilizer) were added. Then, water was added to make the total quantity 260 ml.

Preparation of Latex

To 40 l of water, 0.25 kg of a sodium salt of a sulfuric acid ester of dextrane (KMDS, manufactured by Meito Sangyo) and 0.05 kg of ammonium persulfate were added. To the resulting solution, a mixture of 4.51 kg of n-butyl acrylate, 5.49 kg of styrene and 0.1 kg of acrylic acid was added with stirring at 81° C. and in an nitrogen atmosphere over a period of 1 hour. Then, 0.005 kg of ammonium persulfate was added, and stirred for further 1.5 hours. The solution was then cooled, and adjusted to have a pH of 6 with aqueous ammonia. The so-obtained latex was subjected to filtering by means of a GF/D filter (manufactured by Whatman). Water was added to the filtrate to make the total quantity 50.5 kg. As a result, a latex consisting of mono-dispersed grains with an average grain size of 0.25 μm was obtained.

Preparation of Coating Liquid for Emulsion Layer

To the emulsion obtained above, 9 mg of compound A was added, and pH was adjusted to 6.5 with a 0.5N sodium hydroxide solution. Then, 360 mg of compound T was added. Subsequently, 5 ml (per mol silver halide) of a 20% aqueous solution of saponin, 180 mg of sodium dodecylbenzenesulfonate, 80 mg of 5-methylbenzotriazole, 43 mg of the above obtained latex, 60 mg of compound M and 280 mg of a water-soluble styrene-maleic acid copolymer (a thickener) were added in sequence. Water was added to make the total quantity 475 ml, whereby a silver halide emulsion coating liquid was obtained.

Preparation of Coating Liquid for Protective Layer

Water was added to gelatin to allow it to swell. The swollen gelatin was dissolved by heating to 40° C. Then, an aqueous 1% solution of compound Z (a coating aid), compound N (a filter dye) and compound D (a filter dye) were added in sequence. Then, pH was adjusted to 6.0 with acetic acid. Then, amorphous silica powder (particle size: 4.0 μm) was added as a matting agent, whereby a coating liquid for a protective layer was added.

Compound T

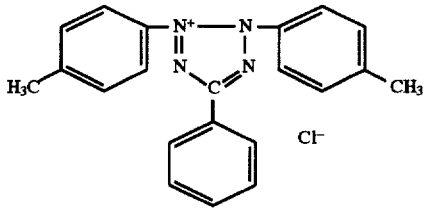

Compound Z

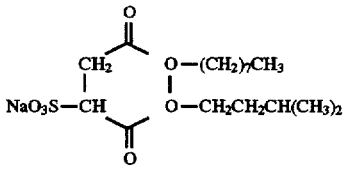

Compound M

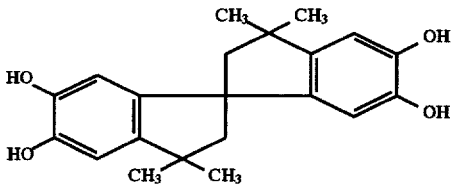

Compound A

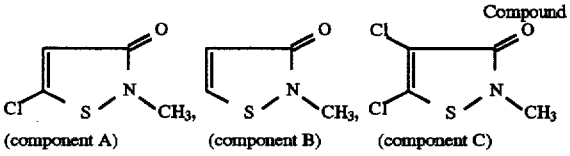

(component A) (component B) (component C)

Component A:Component B:Component C = 50:46:4 (molar ratio)

-continued

Compound N

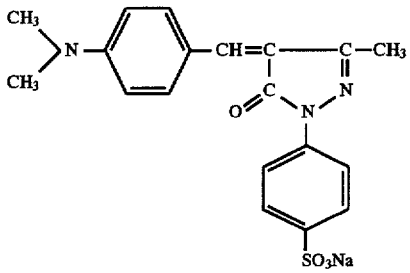

Compound D

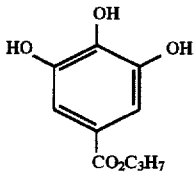

Preparation of Coating Liquid for Backing Layer

Water was added to 36 g of gelatin to allow it to swell. The swollen gelatin was dissolved by heating. As a dye, an aqueous solution of 1.6 g of compound C-1, 310 mg of compound C-2 and 1.9 g of compound C and 2.9 g of compound N were added. Then, an 11 ml aqueous 20% solution of saponin, 5 g of compound C-4 (a physical properties controlling agent) and 63 mg of a methanol solution of compound C-5 were added. To this solution, 800 g of a water-soluble styrene-maleic acid copolymer (a viscosity controller) was added to control the viscosity of the solution, and pH was adjusted to 5.4 with an aqueous solution of citric acid. Then, 1.5 g of a reaction product of polyglycerol and epichlorohydrin and 144 mg of glyoxal were added. Water was added to make the total quantity 960 ml, whereby a coating liquid (B-1) for a backing layer was prepared.

Compound C-1

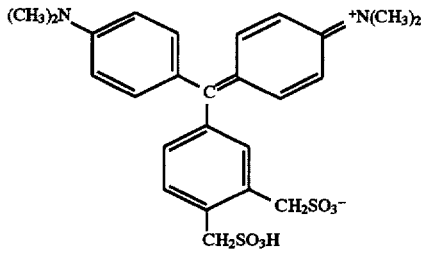

Compound C-2

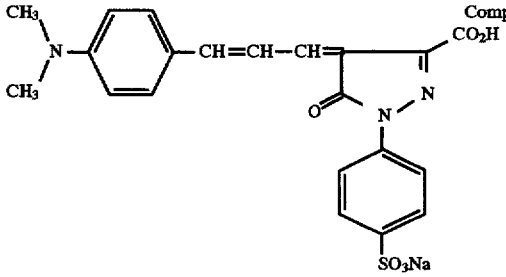

-continued

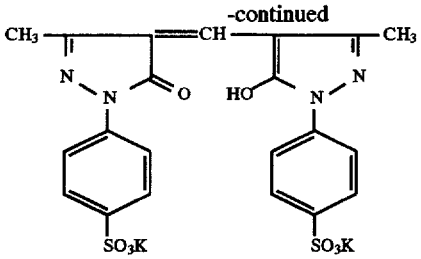

Compound C-3

A latex of a copolymer of

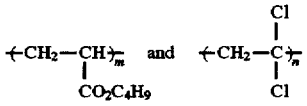

Compound C-4 m:n = 1:1 (weight ratio)

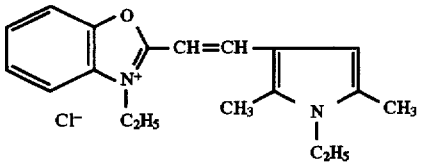

Compound C-5

Preparation of Coating Liquid for Protective Layer for Backing Layer

Water was added to 50 g of gelatin to allow it to swell. The swollen gelatin was dissolved by heating. To the gelatin, 340 mg of a sodium salt of a bis (2-ethylhexyl) ester of 2-sulfonate-succinic acid, 3.4 g of sodium chloride, 1.1 g of glyoxazol and 540 mg of mucochloric acid were added. Then, spherical polymethyl methacrylate particles (average particle size: 4 μm) were added as a matting agent such that their content in the resulting protective film would be 40 mg per square meter of the film. Water was added to make the total quantity 1 l, whereby a coating liquid for a protective layer (B-2) was obtained. The so-obtained sample was exposed to light through a half-tone screen in the usual way, and processed according to the following procedure and by using the following processing liquids.

Processing Procedure

| Procedure | Temperature (°C.) | Time (sec) |
|---|---|---|
| Developing | 34° C. | 15 sec |
| Fixing | 34° C. | 15 sec |
| Reducing | 20° C. | 20 sec |
| Rinsing | Ordinary Temp. | 10 sec |
| Drying | 40° C. | 9 sec |

Developer

| Composition A | |
|---|---|
| Water | 150 ml |
| Disodium ethylenediaminetetraacetate | 2 g |
| Diethylene glycol | 50 g |
| Potassium sulfite (aqueous 55% w/v solution) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide | |
| An amount enough to make pH to 10.9. | |
| Potassium bromide | 4.5 g |
| **Composition B** | |
| Water | 3 ml |
| Diethylene glycol | 50 g |
| Disodium ethylenediaminetetraacetate | 25 mg |
| Acetic acid (aqueous 90% w/w solution) | 0.3 ml |
| 5-Nitroindazole | 110 mg |
| 1-Phenyl-3-pyrazolidone | 500 mg |

To 500 ml of water, compositions A and B were added in sequence and dissolved. Water was added to make the total quantity 1 l.

Fixer

| Composition A | |
|---|---|
| Ammonia thiocyanate (aqueous 72.5% w/w solution) | 230 ml |
| Sodium sulfite | 9.5 g |
| Sodium acetate trihydrate | 15.9 g |
| Boric acid | 6.7 g |
| Sodium citrate dihydrate | 2 g |
| Acetic acid (aqueous 90% w/w solution) | 8.1 ml |
| **Composition B** | |
| Water | 17 ml |
| Sulfuric acid (aqueous 50% w/w solution) | 5.8 g |
| Aluminum sulfate [aqueous 8.1% (in terms of $Al_2O_3$) w/w solution] | 26.5 g |

To 500 ml of water, compositions A and B were added in sequence and dissolved. Water was added to make the total quantity 1 l. The pH of this liquid was 4.3.

Meanwhile, % w/w means weight by weight percent and % w/v means weight by volume percent.

Reducing was performed by using the bleachers employed in Experiment Nos. 3-25 to 3-42 in Example 3.

The results obtained revealed that a ferric complex salt of a compound of the invention was effective as a reducing agent, and could provide a safe reducer improved in biodegradability.

What is claimed is:

1. A method of processing an exposed silver halide color photographic light-sensitive material comprising the steps of:

color developing the light-sensitive material with a color developing solution comprising a color developing agent, and treating the light-sensitive material with a solution having a bleaching capability, after said color developing step, wherein said solution having a bleaching capability comprises a ferric complex salt of a compound represented by the following formula A:

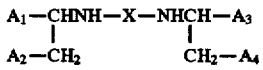

(A)

wherein $A_1$, $A_2$, $A_3$ and $A_4$ are independently a $—CH_2OH$ group, a $—PO_3M_2$ group or a —COOM group, which may be the same or different; M is a cation; and X is an alkylene group having 2 to 6 carbon atoms or a $—(B_1O)_n—B_2—$ group, in which n is an integer of 1 to 8, and $B_1$ and $B_2$ are independently an alkylene group having 1 to 5 carbon atoms, which may be the same or different; provided that said compound represented by said formula A does not consist essentially of an optical isomer about the carbon atoms to which $A_1$ and $A_3$ are bonded.

2. The method of claim 1, wherein said solution having a bleaching capability is a bleaching solution to be used for bleaching a silver halide color photographic light-sensitive material.

3. The method of claim 2, wherein said bleaching solution contains said ferric complex salt in an amount of 0.05 to 2.0 mol per liter.

4. The method of claim 2, wherein said bleaching solution contains ammonium ions in a ratio of not more than 50 mol % of all cations contained in said bleaching solution.

5. The method of claim 1, wherein said solution having a bleaching capability is a bleach-fixer to be used for bleach-fixing a silver halide color photographic light-sensitive material.

6. The method of claim 5, wherein said bleach-fixer contains said ferric complex salt in an amount of 0.05 to 2.0 mol per liter.

7. The method of claim 5, wherein said bleach-fixer contains ammonium ions in a ratio of not more than 50 mol % of all cations contained in said bleach-fixing solution.

8. The method of claim 5, wherein said bleach-fixer further contains a compound represented by the following Formula FA;

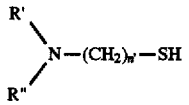

(FA)

wherein R' and R" are each a hydrogen atom, an alkyl group, an aryl group, an aralkyl group or a heterocyclic group; and n' is an integer of 2 or 3.

9. The method of claim 8, wherein said bleach-fixer contains said compound of formula FA in an amount of 0.1 g to 200 g per liter.

10. The method of claim 1 wherein said solution having a bleaching capability further comprises a thiosulfate.

11. The method of claim 1, wherein said compound of formula A is selected from the group consisting of compounds of formulae A-1 through A-17 as shown below:

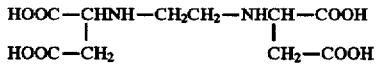

A-1

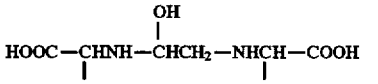

A-2

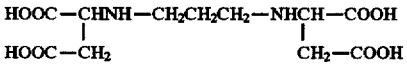

A-3

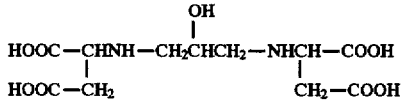

A-4

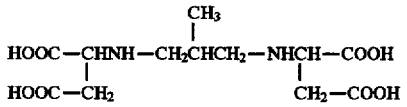

A-5

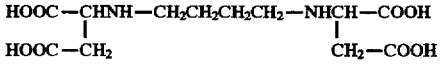

A-6

-continued

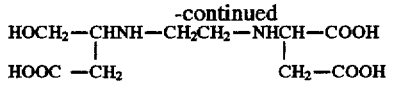

A-7

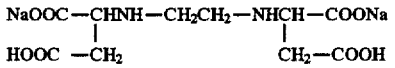

A-8

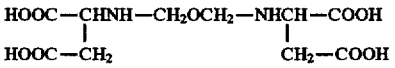

A-9

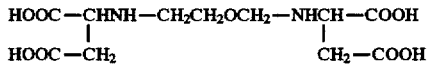

A-10

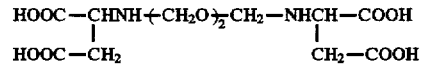

A-11

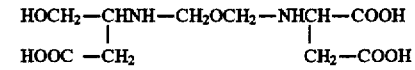

A-12

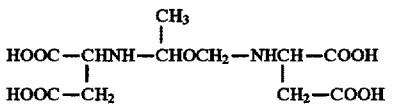

A-13

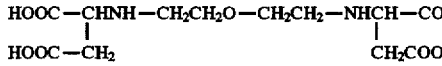

A-14

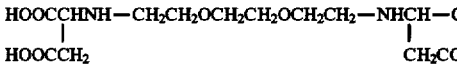

A-15

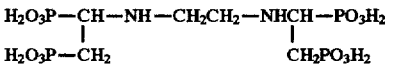

A-16

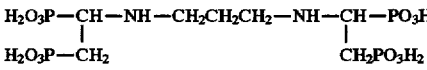

A-17

12. The method of claim 11, wherein said solution having a bleaching capability is a bleaching solution or a bleach-fixing solution to be used for bleaching or bleach-fixing a silver halide color photographic light-sensitive material.

13. The method of claim 12, wherein said solution having bleaching capability contains said ferric complex salt in an amount of 0.05 to 2.0 mol per liter.

14. The method of claim 13, wherein said bleaching solution contains ammonium ions in a ratio of not more than 50 mol % of all cations contained in said bleaching solution.

15. The method of claim 14 wherein said compound of formula A is said compound A-1, A-3 or A-14.

16. The method of claim 15 wherein said compound of formula A is present in an amount of 0.1 to 1.0 mol per liter.

17. The method of claim 13 wherein said compound of formula A is present in an amount of 0.1 to 1.0 mol per liter.

18. The method of claim 11, wherein said solution having bleaching capability contains said ferric complex salt in an amount of 0.05 to 2.0 mol per liter.

19. The method of claim 13, wherein the solution having bleaching capability is a bleach-fixer and further contains 0.1 to 200 g per liter of a compound represented by the following Formula FA;

Formula FA;

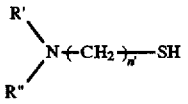

(FA)

wherein R' and R" are each a hydrogen atom, an alkyl group, an aryl group, an aralkyl group or a heterocyclic group; and n' is an integer of 2 or 3.

20. The method of claim 19 wherein said solution having a bleaching capability further comprises a thiosulfate.

21. An aqueous processing solution for a silver halide color photographic light-sensitive material, said processing solution being a bleaching solution or a bleach-fixing solution which comprises a halide and a ferric complex salt of a compound represented by the Formula (A)

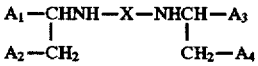

(A)

wherein $A_1$, $A_2$, $A_3$ and $A_4$ are independently a $—CH_2OH$ group, a $—PO_3M_2$ group or a —COOM group, which may be the same or different; M is a cation; and X is an alkylene group having 2 to 6 carbon atoms or a $—(B_1O)_n—B_2—$ group, in which n is an integer of 1 to 8, and $B_1$ and $B_2$ are independently an alkylene group having 1 to 5 carbon atoms, which may be the same or different; provided that said compound represented by said formula A does not consist essentially of an optical isomer about the carbon atoms to which $A_1$ and $A_3$ are bonded.

* * * * *